United States Patent [19]

Martell et al.

[11] 4,359,953

[45] Nov. 23, 1982

[54] CONTROL SYSTEM FOR SEWING MACHINE

[75] Inventors: Charles R. Martell; Elmer N. Leslie; Don D. Isett, all of Dallas; Stephen S. Treadwell, Richardson, all of Tex.

[73] Assignee: Microdynamics, Inc., Dallas, Tex.

[21] Appl. No.: 168,525

[22] Filed: Jul. 14, 1980

[51] Int. Cl.[3] ..... D05B 19/00

[52] U.S. Cl. ..... 112/121.11; 112/275

[58] Field of Search ..... 112/121.11, 121.12, 112/272, 275, 277, 2, 153

[56] References Cited

U.S. PATENT DOCUMENTS

| | | | |
|---|---|---|---|
| 3,613,608 | 4/1971 | Hinerfeld | 112/2 |
| 3,750,603 | 8/1973 | Martin | 112/121.11 X |
| 3,827,381 | 8/1974 | Baanstra et al. | 112/121.11 |
| 3,928,752 | 11/1975 | Darwin | 235/92 PD |
| 3,970,014 | 7/1976 | Chano et al. | 112/121.11 |
| 4,051,794 | 1/1977 | Herzer et al. | 112/121.12 |
| 4,074,640 | 2/1978 | Chano et al. | 112/121.11 |
| 4,092,937 | 6/1978 | Landau, Jr. et al. | 112/121.11 |
| 4,100,865 | 7/1978 | Landau, Jr. et al. | 112/121.11 |
| 4,104,976 | 7/1978 | Landau, Jr. et al. | 112/121.11 |
| 4,107,592 | 8/1978 | Bayer | 318/568 |
| 4,108,090 | 8/1978 | Landau, Jr. et al. | 112/121.11 |
| 4,133,275 | 1/1979 | Herzer et al. | 112/121.12 |

OTHER PUBLICATIONS

Vol. 3, No. 3, Journal of the Apparel Research Foundation (1969), pp. 1–32.

*Primary Examiner*—Peter P. Nerbun
*Attorney, Agent, or Firm*—Jerry W. Mills

[57] ABSTRACT

A semiautomatic sewing system (10) comprises a sewing machine (12), a drive unit (42) including a variable speed motor and encoder for counting stitches sewn, material edge sensors (40) mounted in spaced relationship in front of the needle (22) of the sewing machine, and a microprocessor controller (51) coupled to the sewing machine controls. Accurate control of seam lengths and end points is achieved by initiating countdown of a variable preprogrammed number of final stitches responsive to material edges detected by the sensors (40) only when the stitch count falls within a predetermined window of values so that inaccuracies from stitch counting are limited to a small portion of the overall seam length. If the sensors (40) do not detect a material edge within the window of stitch values, the sewing system (10) reverts to pure stitch counting to determine seam length.

32 Claims, 13 Drawing Figures

TEACH MODE

AUTO MODE

CONTROL SYSTEM FOR SEWING MACHINE

TECHNICAL FIELD

The present invention relates generally to a control system to adapt a sewing machine for semi-automatic operation. More particularly, this invention is directed to an adaptive sewing machine control system incorporating a microprocessor controller in combination with stitch counters and edge sensors to achieve more precise seam lengths and end points.

BACKGROUND ART

In the sewn goods industry, where various sections of material are sewn together to fabricate products, reasonably precise seam lengths and/or end points are often necessary for proper appearance and function of the finished products. Consider, for example, the collar of a shirt or other garment. The top stitch seam must closely follow the contour of the collar and terminate at a precise point. In the construction of shoes, accurate seam lengths must be maintained when sewing together the vamps and quarter pieces to achieve strength as well as pleasing appearance. Seams with imprecise lengths and/or end points can result in unacceptable products or rejects, thus causing waste and further expense.

Achieving consistently accurate seam lengths and/or end points at high rates of production, however, has been a long standing problem in the industry. Sewing machines traditionally have been controlled by human operators. Rapid coordination of the operator's eyes, hands and feet is necessary to control a high speed industrial sewing machine. Considerable practice, skill and concentration are required to sew the same type of seam with consistent accuracy time and time again.

Since such sewing operations tend to be repetitive and therefore lend themselves to automation, systems have been developed heretofore for automatically controlling sewing machines. U.S. Pat. Nos. 4,108,090, 4,104,976, 4,100,865 and 4,092,937 assigned to the Singer Company are representative of such devices. Each of these patents discloses a programmable sewing machine with three operational modes: manual, auto and learning. Control parameters are programmed into the system as the operator manually performs the initial sewing procedure for subsequent control of the sewing machine in the auto mode.

While these programmable sewing machines have several advantages over manually controlled machines, they are not without their disadvantages. The prior systems rely upon overall stitch counting to determine seam lengths and/or end points, variations in which can be caused by several factors. First, cloth or fabric is a relatively elastic material which can be stretched or contracted by the operator during the sewing procedure, thereby causing changes in average stitch lengths which can accumulate into a significant deviation over the length of a seam. Second, slippage can occur as the material is advanced between the presser foot and feed dog of the sewing machine, thereby causing further deviations in the length of the seam. Also, such slippage can vary in accordance with the speed of the sewing machine. Third, any deviations between the paths of the desired seams versus the paths of the seams as programmed can also contribute to inaccurate seam lengths. Variations in seam lengths become greatest with long seams and elastic material.

Thus, although the programmable sewing machines of the prior art offer higher speeds of operation, they have not been satisfactory in those applications where precise seam lengths and end points are required.

Another approach to the problem of stopping a sewing machine precisely and consistently at a given point was proposed in an article entitled "Fluidics for the Apparel Industry", Journal of the Apparel Research Foundation, Vol. 3, 1969. It was proposed to mount a sensor in the presser foot of the sewing machine for sensing the edge of the material by which to initiate countdown of a preset number of stitches for stopping the machine at the desired point. This proposal, however, does not take into account the fact that edge conditions are dependent upon the seam and type of workpiece. No single preset number of stitches works well with pieces of different shapes or similar pieces of different sizes. As far as Applicants are aware, however, this proposal never has been embodied in a programmable sewing system.

A need therefore has arisen for an adaptive sewing machine control system utilizing a combination of stitch counting and edge detection techniques to obtain more accurate seam lengths and/or end points.

SUMMARY OF THE INVENTION

The present invention comprises a sewing machine control system which overcomes the foregoing and other difficulties associated with the prior art. In accordance with the invention, there is provided a system including a microprocessor controller which can be programmed with or taught a sequence of sewing operations by the operator in one mode, while sewing the initial piece, for automatically controlling the machine during subsequent sewing of similar pieces of the same or different sizes in another mode. The semi-automatic system herein does not rely upon either pure stitch counting or material edge detection alone, but rather utilizes a combination of these techniques together with other features to achieve more accurate seam length and end point control.

More specifically, this invention comprises a microprocessor-based control system for an industrial sewing machine. The system has manual, teach and auto modes of operation. In the preferred embodiment, one or more sensors are mounted in front of the presser foot for monitoring edge conditions of the material at the end of each seam. In the teach mode, operating parameters are programmed into the controller by the operator while manually sewing the first piece. For each seam, the number of stitches X sewn at the time of the last status change in the sensors, the sensor pattern after X stitches had been sewn, and the total number of stitches Y sewn in the seam are recorded along with sewing machine and auxiliary control inputs. In the auto mode, the number of stitches sewn in each seam is monitored as the count passes a window set up around X until the characteristic sensor pattern is seen, at which time $Y-X$ additional stitches are sewn to complete the seam.

The number of terminal stitches, as well as the point at which stitch countdown is initiated, can vary from seam to seam such that the present control system is adaptive. Thus, more accurate seam lengths and/or end points are achieved by applying stitch counting to only a very small portion of the terminal end of each seam.

BRIEF DESCRIPTION OF DRAWINGS

A more complete understanding of the invention can be had by reference to the following Detailed Description in conjunction with the accompanying Drawing, wherein.

DETAILED DESCRIPTION

Figure 1:
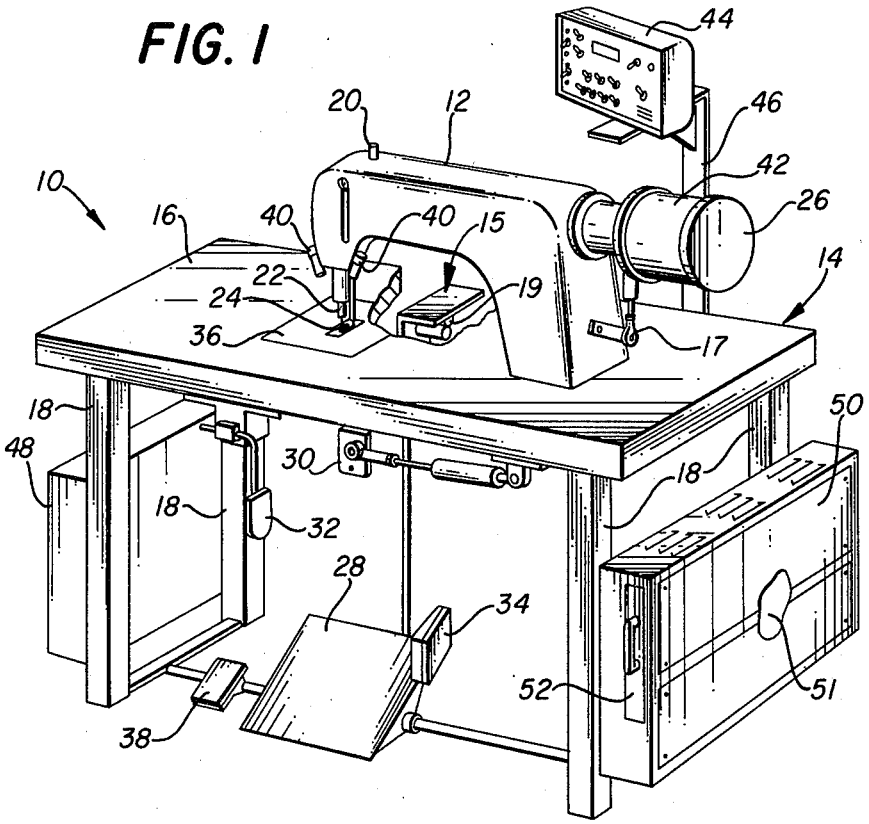
FIG. 1 is a perspective view of a programmable sewing system incorporating the invention.

Referring now to the Drawings, wherein like reference numerals designate like or corresponding parts throughout the views, FIG. 1 illustrates a semi-automatic sewing system 10 incorporating the invention. System 10 is a microprocessor-based system adapted to extend the capabilities of a sewing machine by enabling the operator to perform sewing procedures on a manual or semi-automatic basis, as will be more fully explained hereinafter.

System 10 includes a conventional sewing machine 12 mounted on a work stand 14 consisting of a table top 16 supported by four legs 18. Sewing machine 12, which is of conventional construction, includes a spool 20 containing a supply of thread for stitching by a reciprocable needle 22 to form a seam in one or more pieces of material. Surrounding needle 22 is a vertically movable presser foot 24 for cooperation with movable feed dogs (not shown) positioned within tabletop 16 for feeding material past the needle.

A number of standard controls are associated with sewing machine 12 for use by the operator in controlling its functions. A handwheel 26 is attached to the drive shaft (not shown) of machine 12 for manually positioning needle 22 in the desired vertical position. Sewing speed is controlled by a speed sensor 15 which is actuated by a foot treadle 28, which functions like an accelerator. Vertical positioning of presser foot 24 can be controlled by heel pressure on foot treadle 28 which closes a switch 19 in speed sensor 15, which in turn causes the presser foot lift actuator 30 to operate. A leg switch 32 is provided for controlling the sewing direction of machine 12 by causing operation of reverse sew lever actuator 17. A toe switch 34 located adjacent to foot treadle 28 controls a conventional thread trimmer (not shown) disposed underneath the throat plate 36 of machine 12. Foot switch 38 on the other side of foot treadle 28 comprises a one-stitch switch for commanding machine 12 to sew a single stitch.

It will thus be understood that sewing machine 12 and its associated manual controls are of substantially conventional construction, and may be obtained from several commercial sources. For example, suitable sewing machines are available from Singer, Union Special, Pfaff, Consew, Juki, Columbia, Brother or Durkopp Companies.

In addition to the basic sewing machine 12 and its manual controls, system 10 includes several components for adapting the sewing machine for semi-automatic operation. A pair of sensors 40 are mounted in laterally spaced-apart relationship in front of needle 22 and presser foot 24. A drive unit 42 comprising a variable speed direct drive motor, sensors for stitch counting and an electromagnetic brake for positioning of needle 22, is attached to the drive shaft of sewing machine 12. A main control panel 44 supported on a bracket 46 is provided above one corner of work stand 14.

On one side of work stand 14 there is a pneumatic control chassis 48 containing an air regulator, filter and lubricator for the sewing machine control sensors, pneumatic actuators and other elements of system 10. All of these components are of known construction and are similar to those shown in U.S. Pat. Nos. 4,108,090, 4,104,976, 4,100,865 and 4,092,937, the disclosures of which are incorporated herein by reference.

A controller chassis 50 is located on the opposite side of work stand 14 for housing the electronic components of system 10. Chassis 50 includes a microprocessor controller 51, appropriate circuitry for receiving signals from sensors and carrying control signals to actuators, and a power module for providing electrical power at the proper voltage levels to the various elements of system 10. The microprocessor controller 51 may comprise a Zilog Model Z-80 microprocessor or any suitable unit having a read only memory (ROM) and random access memory (RAM) of adequate storage capacities. An auxiliary control panel 52 is mounted for sliding movement in one end of chassis 50. Operation and function of the foregoing components will become more clear in the following paragraphs.

Figure 2:
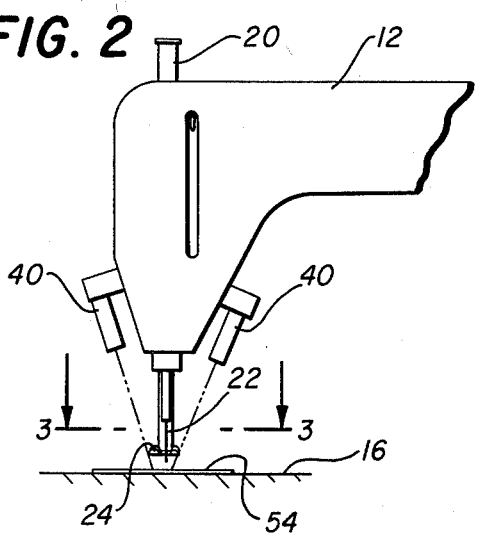
FIG. 2 is a front view illustrating placement of the edge sensors relative to the sewing needle.
Figure 3:
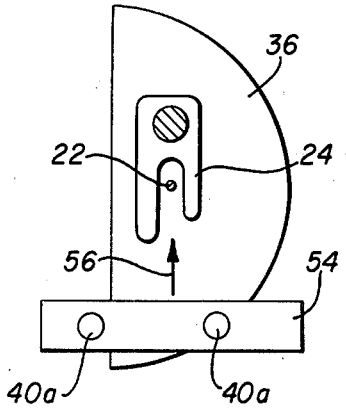
FIG. 3 is a sectional view taken along lines 3—3 of FIG. 2 in the direction of the arrows.

Referring now to FIGS. 2 and 3, further details of edge sensors 40 and their cooperation with needle 22 can be seen. If desired, only one edge sensor 40 can be used with sewing machine 12; however, complex shaped parts may require two or even three edge sensors located in laterally spaced-apart relationship in front of the needle. Sensors 40 can be mounted directly on the housing of sewing machine 12, or supported by other suitable means. As illustrated, each sensor 40 comprises a lamp/photosensor which projects a spot of light 40*a* onto a reflective strip 54 on throat plate 36. The status of each sensor 40 is either on or off depending upon whether the light beam thereof is interrupted, such as by passage of material over reflective strip 54 in the direction of arrow 56 in FIG. 3. Sensors 40 thus function to sense the presence of material being sewn and to signal the approach of the seam end by sensing passage of the trailing edge of the particular piece of material.

It will be appreciated that a significant feature of the present invention comprises usage of at least one and possibly a plurality of sensors 40 positioned in mutually spaced relationship ahead of needle 22 of sewing machine 12. Sensors 40 indicate whether or not the end of a particular seam is being approached. The condition of at least one sensor 40 changes as the trailing material edge passes thereunder to indicate approach of the seam end point. Sensors such as the Model 10-0672-02 available from Clinton Industries of Carlstadt, N.J., have been found satisfactory as sensors 40; however, infrared sensors and emitters, or pneumatic ports in combination with back pressure sensors could also be utilized, if desired. Any type of on/off sensors capable of detecting the presence or absence of material a preset distance in front of needle 22 can be utilized with apparatus 10 since the exact mode of their operation is not critical to practice of the invention.

Figure 4:
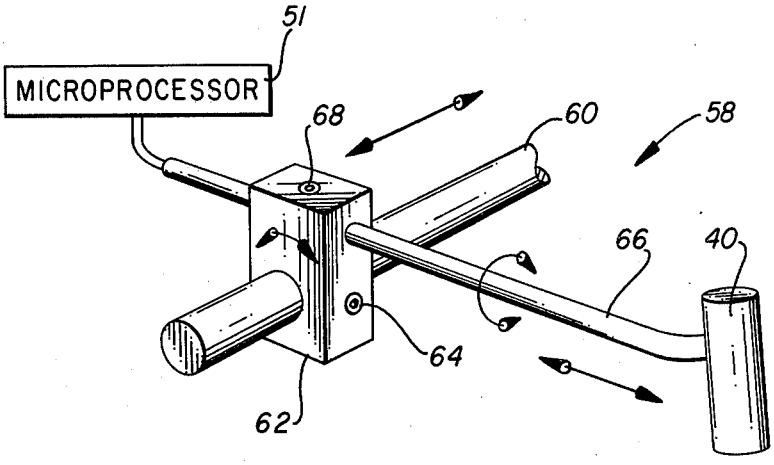
FIG. 4 is an illustration of the sensor mounting.

Sensors 40 can be mounted directly on the housing of sewing machine 12 or on a mounting assembly 58 as shown in FIG. 4. Assembly 58 includes a transverse support bar 60 to which is attached a mounting block 62 for each sensor 40. Mounting blocks 62, only one of which is shown, are slidable and rotatable relative to support bar 60, and can be secured in any desired position thereon by means of set screws 64. Each sensor 40 is attached to the end of a rod 66 slidably extending through its corresponding block 62 and secured in place by set screw 68.

Mounting assembly 58 thus facilitates adjustment of sensors 40 in the desired spaced relationship with respect to each other and with respect to sewing needle 22 in accordance with the shape of the material being sewn and other considerations of the particular sewing operation. Reflective tape 54, of course, could also be repositioned accordingly.

Figure 5:
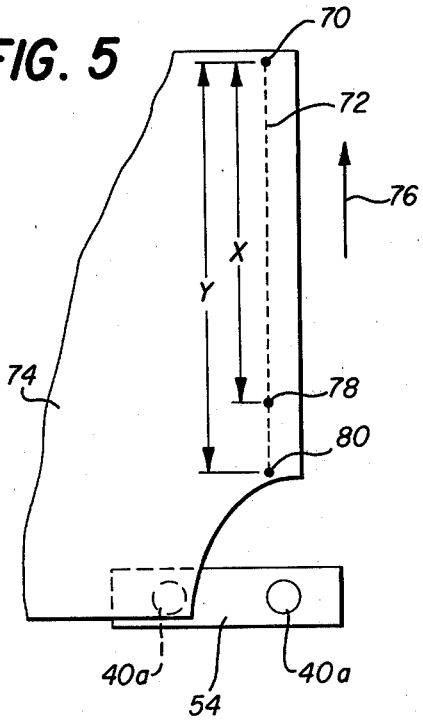
FIG. 5 is an illustration of a piece of material being provided with a seam by means of the invention.

The operation and function of sensors 40 will be better understood upon reference to FIG. 5. Beginning at start point 70, a seam 72 is sewn along a piece of material 74 as the material is fed through sewing machine 12, which is not shown in FIG. 5, in the direction of arrow 76. Simultaneously, the number of stitches from start point 70 is being counted by the encoder within drive unit 42. Since reflective tape 54 is covered for a substantial portion of seam 72, the beams of sensors 40 are blocked and the conditions of both sensors are unchanged. At point 78 in seam 72, after X stitches have been sewn, one of the sensors 40 is cleared to change its condition thereby indicating approach of the end of the seam. Y represents the number of stitches sewn between start point 70 and end point 80 of seam 72. The value $Y-X$ thus represents the number of stitches between points 78 and 80 for each seam.

The values X and Y along with the last change in condition of sensors 40 for each seam are stored and used by microprocessor controller 51 to control sewing machine 12 during operation of system 10 in the AUTO mode. Since the length of each seam and the boundary profile of the material following each seam may vary, it will be appreciated that the values X and Y change with the particular seam and workpiece being sewn such that system 10 is adaptive. In addition to the more common devices found on a sewing machine, such as the presser foot lift actuator, reverse sew actuator and thread trimmer actuator, it will be appreciated that auxiliary devices including stackers, trimmers, guides and zig-zag lever actuators also can be controlled in this fashion as a function of stitch count and material edge detection.

Figure 6:
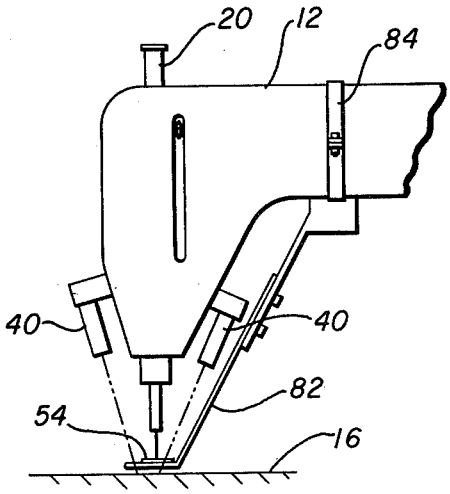
FIG. 6 is a front view of an optional ply splitter.

Referring now to FIG. 6, the seam being sewn may not approach the boundary of the bottom ply of material in some procedures, such as when sewing a patch pocket onto the front panel of a shirt. In such cases tape 54 can be positioned on a ply splitter or separator plate 82 positioned for passage between the upper and lower plies of material. Separator plate 82 can be attached to the housing of sewing machine 12 with a clamp band 84, or supported in any other suitable manner. Use of separator plate 82 thus insures that the boundary of the relevant ply of material being sewn is properly sensed.

Figure 7:
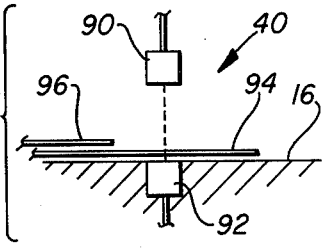
FIG. 7 is an illustration of an alternative sensor.

FIG. 7 illustrates an alternative approach to sensing the boundary of the relevant ply of material being sewn which eliminates the need for a ply splitter or separator plate 82. If desired, each sensor 40 can comprise an infrared emitter 90 of adjustable radiation intensity positioned above an infrared sensor 92 mounted flush in the table top 16. This approach permits adjustment of the output of the infrared emitter 90 in accordance with the number of plies being sewn. For example, when sewing a single ply of material 94, the output of emitter 90 would be set to a relatively low level so that a single layer of material would block sensor 92 and thereby change the condition of sensor 40. On the other hand, if a patch pocket or second ply of material 96 were being sewn onto a first ply of material 94, the energy output level of emitter 90 would be set to a relatively higher level sufficient to penetrate one ply of material but not two plies of material. Suitable infrared emitters and sensors are available from Spectronics, Inc. of Richardson, Tex. Use of such variable sensitivity sensors 40, such as IR emitters and sensors, thus lends additional flexibility to system 10.

Figure 8:
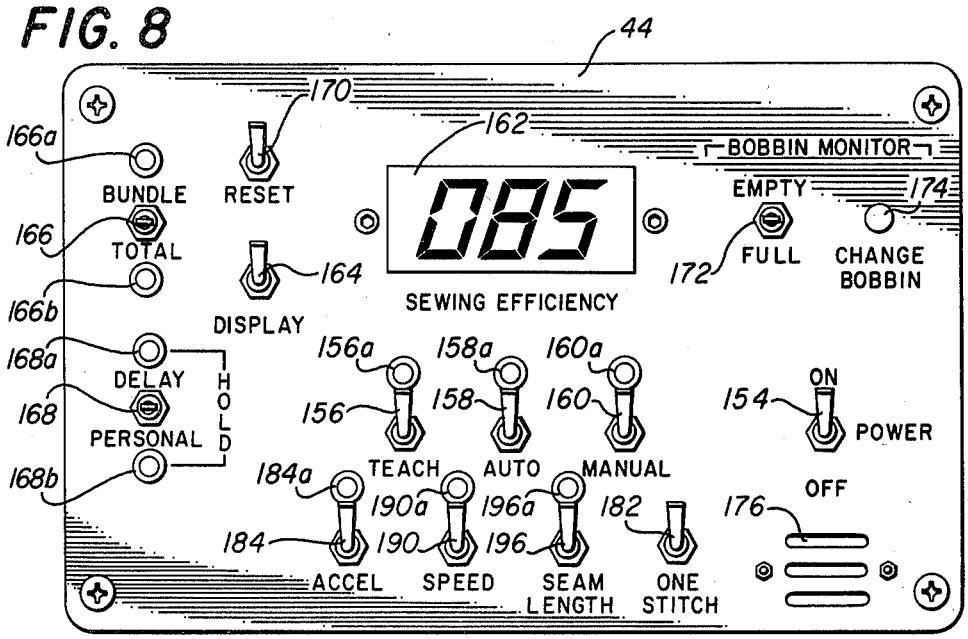
FIG. 8 is a front view of the main control panel.
Figure 9:
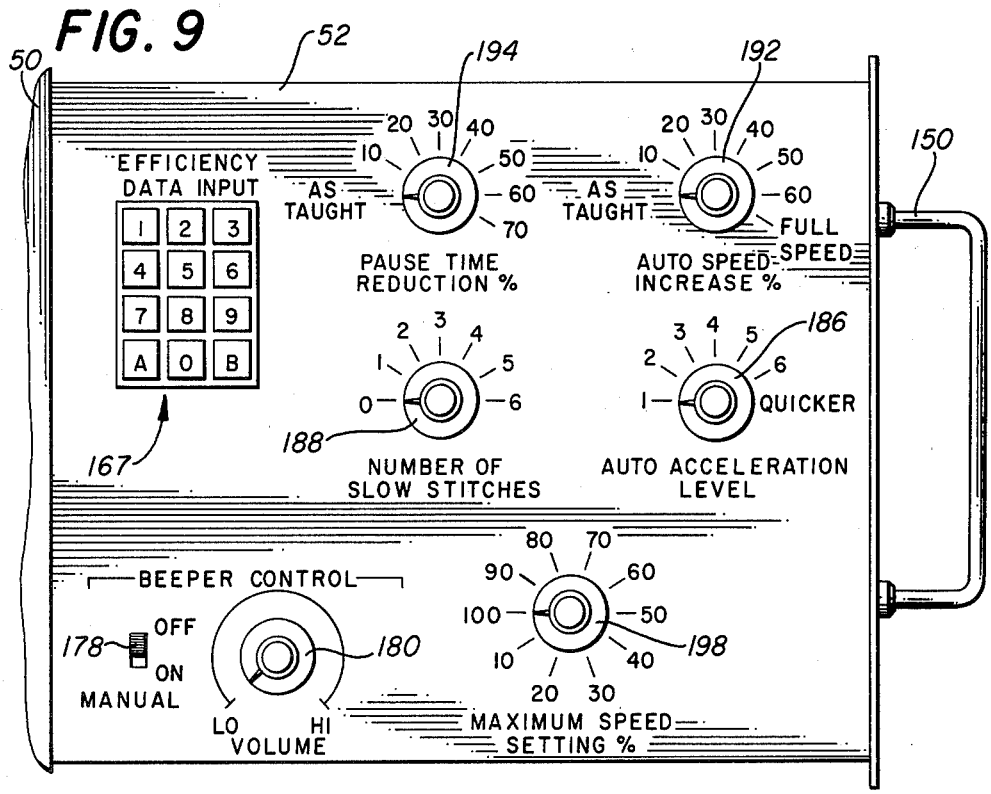
FIG. 9 is a front view of the auxiliary control panel.

The controls for sewing system 10, other than the manual controls associated with sewing machine 12, are found on operator or main control panel 44 and auxiliary control panel 52 shown in FIGS. 8 and 9. The primary controls are located on main panel 44 while auxiliary panel 52 contains adjustment controls. Panel 52 is normally closed within chassis 50, however, the panel can be pulled to an open position by means of handle 150 when adjustments are desired.

With reference to FIG. 8 in particular, main control panel 44 includes a power switch 154 to energize system 10. Switches 158, 156 and 160 are provided for respectively selecting the desired mode of operation. Lamps **156*a*, 158*a* and 160*a* are associated respectively with mode switches 156, 158 and 160** for indicating the particular mode selected.

A three-digit display 162 and associated switch 164 are provided for displaying the operator sewing efficiency being achieved or a predetermined error code upon detection of a malfunction. System 10 computes and displays the percentage sewing efficiency using as a reference the sewing time standard established for the particular sewing operation. Time lost for personal or delay reasons is also recorded and displayed. Switch 166 allows the operator to select the desired efficiency base with lamp **166*a* indicating selection of efficiency per bundle sewn, and with lamp 166*b* indicating selection of total efficiency for a desired period. Hold switch 168 can be moved to the delay or personal positions as indicated by lamps 168*a* and 168*b*, respectively, to interrupt computation of efficiency readings during thread breakage, machine delays, etc. Efficiency computation ceases while hold switch 168 is activated, and the amount of personal or delay time accumulated by the microprocessor controller 51 appears on display 162**.

Switch 170 comprises an efficiency reset switch allowing the operator to clear and reset the sewing efficiency values. If switch 166 is set to bundle, activation of reset switch 170 will clear and reset only the bundle efficiency value and the total values will not be affected.

If switch 166 is set to total, actuation of reset switch 170 will clear and reset both the bundle and total efficiency values.

Switch 172 on control panel 44 is provided for controlling the bobbin-monitoring capability of system 10. This is done by programming microprocessor controller 51 with the number of stitches required to empty a full bobbin in sewing machine 12. Upon installation of a full bobbin, the operator can move switch 172 to the full position and then use sewing machine 12 in any one of the three modes. Upon depletion of the bobbin, switch 172 is then moved to the empty position to terminate counting with the number of stitches required to empty the bobbin. The microprocessor controller 51 thereafter monitors the number of stitches sewn and illuminates lamp 174 and activates a horn behind grill 176 on panel 44 when the switch count reaches a predetermined percentage of the stored value to signal the need to change the bobbin.

Main control panel 44 also includes a one-stitch switch 182 to complement foot switch 38 shown in FIG. 1. Switch 182 can be used in any one of the three operational modes of system 10. Actuation of switch 182 will cause sewing machine 12 to sew a single stitch and leave needle 22 in the down position.

Referring now to FIGS. 8 and 9 together, system 10 includes several controls for further adjusting the operating characteristics of sewing machine 12. Switch 184 can be depressed in the auto mode of operation to modify acceleration and deceleration rates programmed into system 10 in the teach mode. When sewing in the auto mode with switch 184 actuated, which is indicated by lamp 184*a*, microprocessor controller 51 accelerates or decelerates sewing machine 12 via drive unit 42 in accordance with the rates programmed into system 10 in the teach mode. When switch 184 is not actuated, the acceleration and deceleration rates can be changed with rotary switch 186 located on auxiliary panel 52. In addition, a second rotary switch 188 located on panel 52 allows selection of the desired number of slow speed stitches at the beginning of each seam in the auto mode to reduce thread pull-out and other problems at the start of a seam. When switch 184 is reactuated in the auto mode, system 10 reverts to the acceleration rates originally programmed into microprocessor controller 51.

Switch 190 can be depressed in the auto mode of operation to modify sewing speeds programmed into system 10 in the teach mode. When switch 190 is activated in the auto mode, which is indicated by lamp 190*a*, the speed of the sewing machine 12 can be varied by operation of foot treadle 28. When switch 190 is deactivated, the foot treadle 28 acts as an on/off switch such that the speed of sewing machine 12 in the auto mode, with the foot treadle fully depressed, will follow the speed profile sewn in the teach mode. Rotary switch 192 permits the operator to select the amount of speed up in the auto mode over the speed profile programmed during the teach mode. In addition, a second rotary switch 194 permits selective reduction of the sewing pause and presser foot up time intervals over the programmed intervals.

Switch 196 permits the operator to regain manual control of sewing machine 12 in the auto mode of operation. System 10 utilizes a combination of stitch counting and edge detection techniques to control seam lengths and end points; however, there may be situations where the operator anticipates material handling or other difficulties with certain seams. Actuation of switch 196 in the auto mode, coupled with removal of pressure from foot treadle 28, causes system 10 to revert to the manual mode so that the operator can manually complete the seam. System 10 will remain in the manual mode until the operator can manually complete the seam and raise presser foot 24. When presser foot 24 is lowered again and foot treadle 28 is depressed, system 10 will automatically revert to the auto mode and resume sewing of the next seam as programmed. Depression of switch 196 in the teach mode functions to program a command into microprocessor controller 51 at that point along the seam to subsequently invoke the seam length control function in the auto mode so that the seam can be completed manually. Lamp 196*a* indicates actuation of switch 196.

Referring only to FIG. 9, auxiliary control panel 52 further includes a rotary switch 198 for reducing maximum speed of sewing machine 12 in the manual, teach, and auto modes of operation to facilitate the training of operators for system 10.

System 10 operates as follows. Actuation of switch 154 on control panel 44 energizes sewing system 10. Sewing machine 12 can be operated manually by depressing switch 160 and manipulating the hand wheel 26, foot treadle 28, and switches 19, 32, 34 and 38 to control the sewing machine. Foot treadle 28 functions as an accelerator in the manual mode to control the sewing speed of machine 12.

When it is desired to program system 10 with a particular sewing procedure, the teach mode of operation can be selected with switch 156. Typically, this is done before beginning a bundle of pieces of similar sizes and/or shapes. As the first piece is sewn manually by the operator, the microprocessor controller 51 records and stores the following:

(a) number of stitches X and Y sewn in each seam and the status of sensors 40 at the end of the seam;

(b) sewing speed for each stitch;

(c) lifting and lowering of presser foot 24 as a function of stitch count;

(d) time duration during which presser foot 24 is lifted;

(e) operation of reverse sew switch 32 as a function of stitch count;

(f) time duration of any pauses in the sewing operation;

(g) actuation of the thread trimmer and thread wiper as a function of stitch count; and (h) actuation of a plurality of other auxiliary control devices, such as a zig-zag activation switch or throw-out mechanisms of split needle bar machines, as a function of stitch count.

This information is utilized by the microprocessor controller 51 to automatically control operation of sewing machine 12 in the auto mode of system 10. Single stitches sewn at the end of each seam by depression of one-stitch switch 38 or switch 182 are simply added to the taught stitch count. At the completion of each single stitch, needle 24 is left in the down position. Manually entered single stitches, but not the pauses therebetween, are added to the stored seam stitch count. Thus pauses between the single stitches manually entered in the teach mode are ignored by microprocessor controller 51 later in the auto mode such that sewing machine 12 continues at constant speed through the manually entered stitches and then stops, thereby facilitating the teaching of new operators.

After manual completion of the first piece, switch 158 can be actuated to place system 10 in the auto mode for semi-automatic sewing of the remaining pieces. The operator positions the next piece for sewing of the first seam thereof, and then depresses foot treadle 28 to initiate control of sewing machine 12 by the microprocessor. Foot treadle 28 in the auto mode simply functions as an on/off switch with operation of sewing machine 12 being controlled by microprocessor 51. Depression of foot treadle 28 thus causes repeat of the programmed sewing operation as the operator continues to handle and guide the material through sewing machine 12. In the auto mode, the microprocessor controller 51 does not slow sewing machine 12 or pause between stitches which were added in the teach mode by depression of one-stitch switches 38 or 182. Rather, a substantially constant sewing speed, as modified by switch 190, is maintained as the sewing machine approaches the end of each seam, thereby saving considerable time. Release of foot treadle 28 interrupts the automatic sewing sequence.

A significant feature of system 10 is the fact that microprocessor 51 is programmed to set up a window in which the change in status of sensors 40 is expected, thereby eliminating spurious signals. For example, this window can be defined as 75–105% of the stitch count at the time of the last status change in sensors 40 before the end of the seam, which stitch count is represented by X in FIG. 5. Thus, microprocessor controller 51 does not begin to look for the characteristic pattern of sensors 40, and the controller is not responsive to a change in sensor status, until 75% of X stitches have been sewn. When sensors 40 change to their characteristic pattern for that seam, Y−X terminal stitches are sewn to end the seam at a precise point. If the characteristic sensor pattern is not detected within the window defined by 0.75X–1.05X, microprocessor 51 automatically reverts to overall stitch counting for determining seam length and stops sewing machine 12 after Y stitches. Inaccuracies due to stitch counting therefore are reduced to a very small portion of the seam length.

It is advantageous to have a relatively wide window surrounding the stitch count at which a change in sensor status is expected. This permits system 10 to be programmed in the teach mode with a piece of given size to thereafter sew smaller size pieces of the same type in the auto mode without reprogramming the sewing operation. A relatively narrow window, such as 95–105% of X stitches works satisfactorily with pieces of the same size; however, since the transition to the characteristic pattern of sensors 40 on a relatively smaller piece of the same type might not appear in the window, the system would begin the countdown of Y−X stitches at the beginning of the window rather than at the point where the transition actually occurred resulting in an inaccurate seam end point. Thus, another aspect of the adaptive nature of semi-automatic sewing system 10 involves the fact that a sequence of sewing operations taught in the teach mode with a particular piece of one size can be utilized in the auto mode to sew similar pieces of other sizes without reprogramming.

Figure 10:
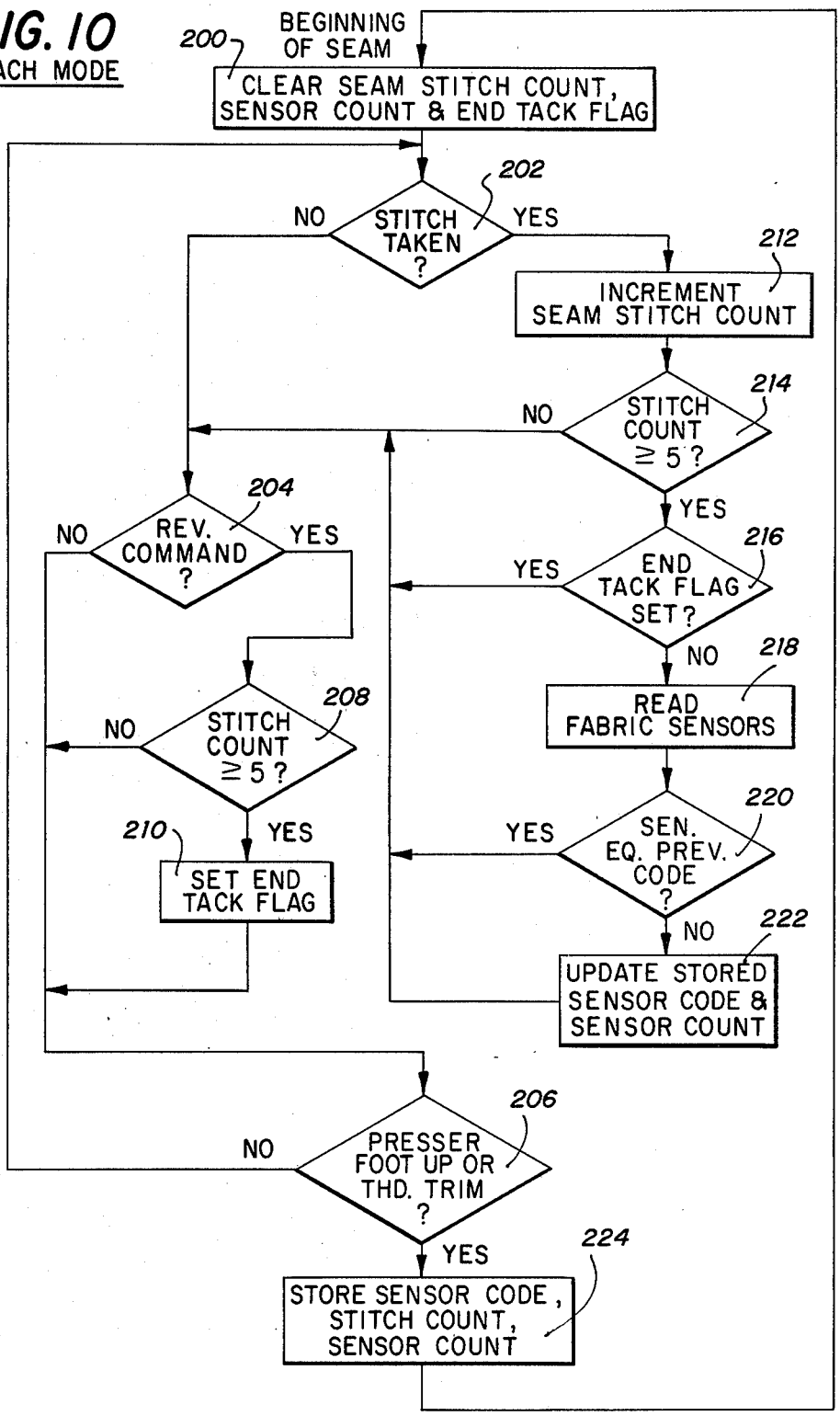
FIG. 10 is a diagram of the control logic of the system in the teach mode.
Figure 11:
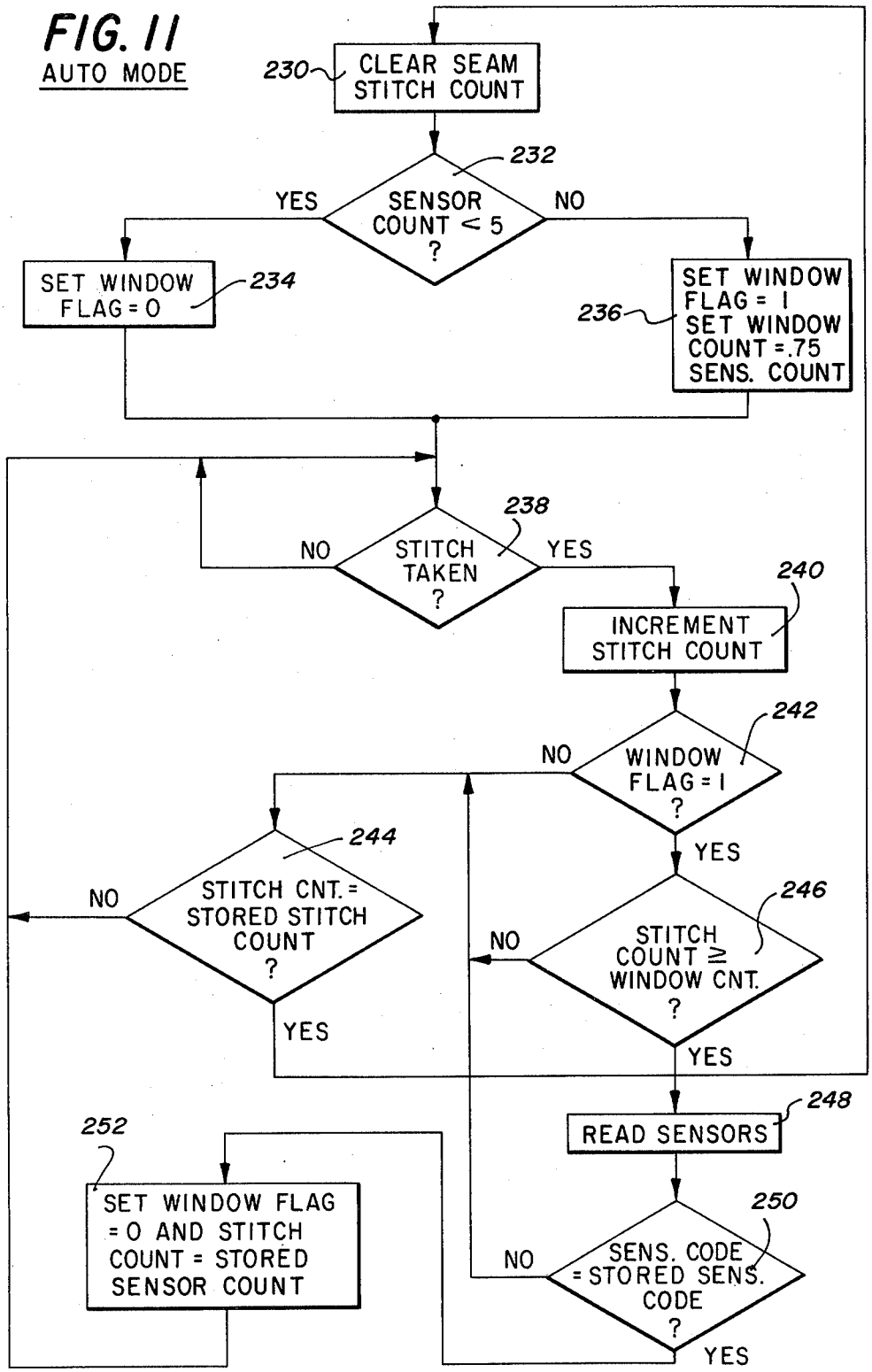
FIG. 11 is a diagram of the control logic of the system in the auto mode.

Referring now to FIGS. 10 and 11, there are shown the flowcharts of the control logic utilized by sensors 40 in the teach and auto modes of system 10. In the flowcharts, the term sensor code means the on/off condition of sensors 40. The term stitch count means the number of stitches taken in a seam. The term sensor count means the number of stitches at the last change in the sensor code. The term window means the zone in which microprocessor 51 is looking for a sensor code corresponding to the programmed sensor code.

Referring to FIG. 10 in particular, the teach mode control logic for each seam begins at 200 by clearing the seam stitch count, sensor count and end tack flag. An inquiry is made at 202 whether a stitch has been taken. If no stitch has been taken, an inquiry is made at 204 whether a reverse command has been received by sewing machine 12. If no stitch has been taken and there has been no reverse command, an inquiry is made at 206 whether pressure foot 24 is up or whether the thread has been trimmed. If no stitch has been taken and there has been a reverse command, an inquiry about the stitch count is made at 208. If the stitch count is less than five the program proceeds directly to 206. If the stitch count is five or more, the end tack flag is set at 210 before proceeding to 206.

If a stitch has been taken, the stitch count is incremented at 212 before an inquiry about the stitch count is made at 214. If the stitch count is five or more, an inquiry is made at 216 as to whether the end tack flag is set. If the end tack flag is not set, fabric sensors 40 are read at 218 before an inquiry is made at 220 whether the condition or code of sensors 40 matches the previous code. If not, then the stored sensor code and sensor count are updated at 222 before proceeding to 204. Depending upon the position of pressure foot 24 or the status of the thread trimmer at 206, the program may go back to 202 or store the sensor code, stitch count and sensor count at 224 before returning to 200.

A sample program listing the microprocessor controller 51 of system 10 in the teach mode is set forth below. The program is particularly adapted for a Zilog Z-80 microprocessor, and is written in Z-80 assembly language in accordance with the Z-80 CPU Manual available from the Zilog Corporation. The program is subdivided into tables as follows:

| TABLE | TEACH MODE PROGRAM |
|---|---|
| 1 | Clearing |
| 2 | Sewing |
| 3 | Storing |

TABLE 1

```
006F'  CD  0000*  00670                CALL   RBSMCL        :CLR CNTRS & END TACK FLG
                  06770  ;
                  06780  ;     ROUTINE TO CLEAR SEAM STITCH COUNTERS AND END TACK FLG
                  06790  ;
03F9'  21  0000   06800  RBSMCL::  LD     HL,0
03FC'  22  005A!  06810            LD     (SMSTCT),HL
03FF'  22  005C!  06820            LD     (FBSNCT),HL
0402'  21  003F!  06830            LD     HL,TCHFL
0405'  CB  9E     06840            RES    3,(HL)
0407'  C9         06850            RET
```

TABLE 1-continued

| | | | | | | | |
|---|---|---|---|---|---|---|---|
| | | | 06860 | | PAGE | | |

TABLE 2

| | | | | | | | |
|---|---|---|---|---|---|---|---|
| 03BA' | 21 | 003C! | 04010 | RS006A: | LD | HL,NDLFLG | ;NDL DN INTR ? |
| 03BD' | CB | 46 | 04020 | | BIT | 0,(HL) | |
| 03BF' | 2B | 49 | 04030 | | JR | Z,RS006B | ;NO |
| 03C1' | CB | 86 | 04040 | | RES | 0,(HL) | ;YES |
| 03C3' | 4F | | 04050 | | LD | C,A | ;SAVE TRDL CNT |
| 03C4' | 2A | 0062! | 04060 | | LD | HL,(SGSTCH) | ;INCR SEG STCH CNT |
| 03C7' | 23 | | 04070 | | INC | HL | |
| 03CB' | 22 | 0062! | 04080 | | LD | (SGSTCH),HL | |
| 03CB' | 2A | 005A! | 04090 | | LD | HL,(SMSTCT) | ;INCR SEAM STCH CNT |
| 03CE' | 23 | | 04100 | | INC | HL | |
| 03CF' | 22 | 005A! | 04110 | | LD | (SMSTCT),HL | |
| 03D2' | ED | 5B 0000* | 04120 | | LD | DE,(FSCNT) | ;IS SM. ST. CT G.T.E. MIN |
| 03D6' | B7 | | 04130 | | OR | A | |
| 03D7' | ED | 52 | 04140 | | SBC | HL,DE | |
| 03D9' | 38 | 0A | 04150 | | JR | C,RS006C | ;NO - NO ACTION |
| 03D8' | 21 | 003F! | 04160 | | LD | HL,TCHFL | ;YES, IS END TACK FL SET? |
| 03DE' | CB | 5F | 04170 | | BIT | 3,(HL) | |
| 03E0' | 20 | 03 | 04180 | | JR | NZ,RS006C | ;YES - NO ACTION |
| 03E2' | CD | 0000* | 04190 | | CALL | RRFS | ;NO - READ FAB SNSRS |
| 03E5' | 21 | 00F7! | 04200 | RS006C: | LD | HL,LSTSPD | |
| 03EB' | 79 | | 04210 | | LD | A,C | ;RESTORE TRDL CNT |
| 03E9' | BE | | 04220 | | CP | (HL) | ;NEW CMD = OLD ? |
| 03EA' | 28 | 05 | 04230 | | JR | Z,RS006D | ;YES |
| 03EC' | CD | 0000* | 04240 | | CALL | RWRST | ;NO |
| 03EF' | 18 | 19 | 04250 | | JR | RS006B | |
| 03F1' | 3A | 0064! | 04260 | RS006D; | LD | A,(MLSTCH) | ;INCR. MULT. ST. CNT |
| 03F4' | 3C | | 04270 | | INC | A | |
| 03F5' | 32 | 0064! | 04280 | | LD | (MLSTCH),A | |
| 03FB' | CB | 6F | 04290 | | BIT | 5,A | ;CNT G.T. 31 ? |
| 03FA' | 28 | 0E | 04300 | | JR | Z,RS006B | ;NO |
| 03FC' | 7E | | 04310 | | LD | A,(HL) | ;YES - WRITE MULT ST. CMD |
| 03FD' | F6 | 80 | 04320 | | OR | B0H | |
| 03FF' | 57 | | 04330 | | LD | D,A | |
| 0400' | 1E | 1F | 04340 | | LD | E,1FH | |
| 0402' | CD | 0000* | 04350 | | CALL | RWRCMD | |
| 0405' | 3E | 01 | 04360 | | LD | A,1 | ;RST MULT ST. CNT TO 1 |
| 0407' | 32 | 0064! | 04370 | | LD | (MLSTCH),A | |
| 040A' | 21 | 003B! | 04380 | RS006B: | LD | HL,FLAGS | |
| 040D' | CB | 76 | 04390 | | BIT | 6,(HL) | ;REV. SW. OPER. ? |
| 040F' | 28 | 43 | 04400 | | JR | Z,RS006E | ;NO |
| 0411' | CB | B6 | 04410 | | RES | 6,(HL) | ;YES |
| 0413' | 21 | 00F7! | 04420 | | LD | HL,LSTSPD | |
| 0416' | 7E | | 04430 | | LD | A,(HL) | |
| 0417' | CD | 0000* | 04440 | | CALL | RWRST | ;WRITE PENDING ST. CMD |
| 041A' | 3E | 00 | 04450 | | LD | A,0 | |
| 041C' | 32 | 0064! | 04460 | | LD | (MLSTCH),A | |
| 041F' | DB | 01 | 04470 | | IN | A,(1) | ;WHICH WAY ? |
| 0421' | CB | 57 | 04480 | | BIT | 2,A | |
| 0423' | 3A | 0095! | 04490 | | LD | A,(CMNDS) | |
| 0426' | 28 | 1E | 04500 | | JR | Z,RS006F | ;FORWARD |
| 0428' | F6 | 02 | 04510 | | OR | 02H | ;CMND REV |
| 042A' | CD | 0000* | 04520 | | CALL | ROUTCD | |
| 042D' | CD | 0000* | 04530 | | CALL | RSETAL | ;SET ALARM |
| 0430' | 2A | 005A! | 04540 | | LD | HL,(SMSTCT) | ;IS SM. ST. CT G.T.E. MIN |
| 0433' | ED | 5B 0000* | 04550 | | LD | DE,(FSCNT) | |
| 0437' | B7 | | 04560 | | OR | A | |
| 0438' | ED | 52 | 04570 | | SBC | HL,DE | |
| 043A' | 38 | 05 | 04580 | | JR | C,RS006G | ;NO |
| 043C' | 21 | 003F! | 04590 | | LD | HL,TCHFL | ;YES, SET END TACK FLAG |
| 043F' | CB | DE | 04600 | | SET | 3,(HL) | |
| 0441' | 11 | A000 | 04610 | RS006G: | LD | DE,0A000H | ;WRITE REV CMD |
| 0444' | 18 | 08 | 04620 | | JR | RS006H | |
| 0446' | E6 | FD | 04630 | RS006F: | AND | 0FDH | ;CMND FOR |
| 0448' | CD | 0000* | 04640 | | CALL | ROUTCD | |
| 044B' | 11 | A100 | 04650 | | LD | DE,0A100H | ;WRITE FORWARD CMD |
| 044E' | CD | 0000* | 04660 | RS006H: | CALL | RWRCMD | |
| 0451' | C3 | 050B' | 04670 | | JP | RS006I | |
| | | | 06870 | ; | | | |
| | | | 06880 | ; ROUTINE TO READ FABRIC SENSORS AND COMPARE TO | | | |
| | | | 06890 | ; PREVIOUS VALUE AND SAVE IF DIFFERENT | | | |
| | | | 06900 | ; | | | |
| 0408' | 3E | 28 | 06910 | RRFS:: | LD | A,050O | ;READ SENSORS |
| 040A' | D3 | 02 | 06920 | | OUT | (2),A | |
| 040C' | DB | 07 | 06930 | | IN | A,(7) | |
| 040E' | E6 | 70 | 06940 | | AND | 70H | |
| 0410' | 47 | | 06950 | | LD | B,A | ;SAVE |
| 0411' | DB | 07 | 06960 | RRFS2: | IN | A,(7) | ;READ AGAIN TO BE SURE |

TABLE 2-continued

```
0413'  E6   70      06970          AND   70H
0415'  B8           06980          CP    B
0416'  28   03      06990          JR    Z,RRFS3        ;OK
0418'  47           07000          LD    B,A            ;DON'T AGREE, READ AGAIN
0419'  18   F6      07010          JR    RRFS2
041B'  06   04      07020  RRFS3:  LD    B,4
041D'  CB   3F      07030  RRFS1:  SRL   A
041F'  10   FC      07040          DJNZ  RRFS1
0421'  21   0060!   07050          LD    HL,FBSNCD      ;COMPARE TO OLD VALUE
0424'  BE           07060          CP    (HL)
0425'  C8           07070          RET   Z              ;SAME - NO ACTION
0426'  77           07080          LD    (HL),A         ;DIFFERENT - SAVE NEW
0427'  2A   005A!   07090          LD    HL,(SMSTCT)    ;SAVE SEAM STCH CNT
042A'  22   005C!   07100          LD    (FBSNCT),HL
042D'  C9           07110          RET
                    07120          PAGE
```

TABLE 3

```
                    00390  ;
                    00400  ; TEACH MODE - PAUSED
                    00410  ;
0030'  DB   01      00420  RST004::  IN    A,(1)          ;IS P.F. DOWN ?
0032'  CB   67      00430           BIT   4,A
0034'  C2   0246'   00440           JP    NZ,RS004R      ;NO
0037'  CD   0000*   00450           CALL  RRDFTR         ;YES - READ FT TRDL
003A'  21   0000*   00460           LD    HL,FTHYST
003D'  BE           00470           CP    (HL)
003E'  DA   0097'   00480           JP    C,RS04KK       ;L.T. HYST.
0041'  32   004F!   00490           LD    (SD),A         ;SET SPD = TRDL CNT
0044'  21   003F!   00500           LD    HL,TCHFL       ;PAUSE DELETE FLG SET ?
0047'  CB   66      00510           BIT   4,(HL)
0049'  28   0E      00520           JR    Z,RS004I       ;NO
004B'  CB   A6      00530           RES   4,(HL)         ;YES - RESET IT
004D'  2A   0054!   00540           LD    HL,(LSTNPC)    ;BACK UP TO LAST NON-PAUSE
0050'  23           00550           INC   HL
0051'  22   0054!   00560           LD    (LSTNPC),HL
0054'  22   0050!   00570           LD    (NXTCMD),HL
0057'  18   03      00580           JR    RS004O
0059'  CD   0000*   00590  RS004I:  CALL  RWRPAU          ;WRITE PAUSE
005C'  CD   0000*   00600  RS004O:  CALL  RPTOFF          ;DISABLE & CLR PAUSE TMR
005F'  21   003F!   00610           LD    HL,TCHFL
0062'  CB   46      00620           BIT   0,(HL)         ;START PC. FLG SET ?
0064'  28   0E      00630           JR    Z,RS004B       ;NO
0066'  CD   0000*   00640           CALL  RINIEF         ;YES - FORCE BNDL OR TTL
0069'  CD   0000*   00650           CALL  REFFBP         ;CALC. EFF.
006C'  CD   0000*   00660  RS004E:  CALL  RWNBSM         ;WRITE NEW BEG. SM.
006F'  CD   0000*   00670           CALL  RBSMCL         ;CLR CNTRS & END TACK FLG
0072'  18   0F      00680           JR    RS004C
0074'  CB   4E      00690  RS004B:  BIT   1,(HL)         ;IS STRT SM FLG SET ?
0076'  28   08      00700           JR    Z,RS004D       ;NO
0078'  CD   0000*   00710           CALL  RBSMFL         ;YES-FILL IN LAST BEG. SM
007B'  CD   0000*   00720           CALL  RBSFIL         ;FILL IN LAST BEG. SEG.
007E'  1B   EC      00730           JR    RS004E
0080'  CD   0000*   00740  RS004D:  CALL  RBSFIL
0083'  21   003F!   00750  RS004C:  LD    HL,TCHFL       ;CLR START SM., PC. FLAGS
0086'  CB   86      00760           RES   0,(HL)
0088'  CB   8E      00770           RES   1,(HL)
008A'  CD   0000*   00780           CALL  RWNBSG         ;WRITE NEW BEGIN SEG.
008D'  21   003E!   00790           LD    HL,CTLFL       ;CLR JOG FLAG
0090'  CB   B6      00800           RES   6,(HL)
0092'  0E   05      00810           LD    C,5            ;GO TO SEWING - WAITING
0094'  C3   0000*   00820           JP    RSTCHG
                    06100  ;
                    06110  ; ROUTINE TO INSERT FABRIC SENSOR CODE AND SEAM STITCH
                    06120  ; COUNT INTO BEGIN SEAM COMMAND
                    06130  ;
039A'  2A   0058!   06140  RBSMFL::  LD    HL,(BSMPTR)
039D'  3A   0060!   06150           LD    A,(FBSNCD)     ;GET FABRIC SENSOR CODE
03A0'  CB   27      06160           SLA   A
03A2'  CB   27      06170           SLA   A
03A4'  B6           06180           OR    (HL)
03A5'  77           06190           LD    (HL),A         ;STORE
03A6'  E5           06200           PUSH  HL             ;SAVE BEG. SEAM PNTR
03A7'  2A   005A!   06210           LD    HL,(SMSTCT)    ;FBSNCT G.T.E. SMSTCT
03AA'  ED   5B 005C! 06220          LD    DE,(FBSNCT)
03AE'  37           06230           SCF
03AF'  ED   52      06240           SBC   HL,DE
03B1'  30   01      06250           JR    NC,RBSMF2      ;NO
03B3'  1B           06260           DEC   DE             ;YES - MAKE L.T. SMSTCT
03B4'  E1           06270  RBSMF2:  POP   HL
```

TABLE 3-continued

| | | | | | | | |
|---|---|---|---|---|---|---|---|
| 03B5' | 4B | | 06280 | | LD | C,E | ;SAVE LSB |
| 03B6' | 7A | | 06290 | | LD | A,D | ;GET UPPER 2 BITS |
| 03B7' | E6 | 0C | 06300 | | AND | 0CH | |
| 03B9' | CB | 3F | 06310 | | SRL | A | |
| 03BB' | CB | 3F | 06320 | | SRL | A | |
| 03BD' | B6 | | 06330 | | OR | (HL) | ;STORE |
| 03BE' | 77 | | 06340 | | LD | (HL),A | |
| 03BF' | 23 | | 06350 | | INC | HL | |
| 03C0' | 7A | | 06360 | | LD | A,D | ;GET MIDDLE 5 BITS |
| 03C1' | E6 | 03 | 06370 | | AND | 3 | |
| 03C3' | 57 | | 06380 | | LD | D,A | |
| 03C4' | 06 | 03 | 06390 | | LD | B,3 | |
| 03C6' | CB | 23 | 06400 | RBSMF1: | SLA | E | |
| 03C8' | CB | 12 | 06410 | | RL | D | |
| 03CA' | 10 | FA | 06420 | | DJNZ | RBSMF1 | |
| 03CC' | 7A | | 06430 | | LD | A,D | |
| 03CD' | B6 | | 06440 | | OR | (HL) | ;STORE MID BITS |
| 03CE' | 77 | | 06450 | | LD | (HL),A | |
| 03CF' | 23 | | 06460 | | INC | HL | |
| 03D0' | 79 | | 06470 | | LD | A,C | ;GET LOWER 5 BITS |
| 03D1' | E6 | 1F | 06480 | | AND | 1FH | |
| 03D3' | B6 | | 06490 | | OR | (HL) | |
| 03D4' | 77 | | 06500 | | LD | (HL),A | ;STORE |
| 03D5' | C9 | | 06510 | | RET | | |
| | | | 06520 | | PAGE | | |

Referring particularly to FIG. 11, the control logic in the auto mode begins by clearing the seam stitch count at 230 before checking the sensor count at 232. If the sensor count is less than five, the window flag is set to zero at 234. If the sensor count is five or more, the window flag is set to one and the window count is set to 0.75 of the sensor count at 236. An inquiry is then made at 238 whether a stitch has been taken, and if not, the system continues looking for a stitch. If a stitch has been taken, the stitch count is incremented at 240 before checking the window flag at 242. If the window flag is zero and thus not equal to one, the stitch count is compared to the stored stitch count at 244, after which the program may go to 238 or 230. If the window flag equals one, the stitch count is compared to the window count at 246. Should the stitch count be less than the window count, the program then goes to 244. Should the stitch count be equal to or greater than the window count, sensors 40 are then read at 248 before comparing the sensor code to the stored sensor code at 250. If the sensor code does not match the stored sensor code, the program proceeds to 244. Should the sensor code match the stored sensor code, the window flag is set to zero and the stitch count is set to the stored sensor count at 252 before proceeding back to 238.

A program listing for the microprocessor controller 51 of system 10 in the auto mode is set forth below. The program is particularly adapted for a Zilog Z-80 microprocessor, and is written in Z-80 assembly language in accordance with the Z-80 CPU Manual available from Zilog Corporation. The program is subdivided tables as follows:

| TABLE | AUTO MODE PROGRAM |
|---|---|
| 4 | Clearing and initialization |
| 5 | Sewing |
| 6 | Adjustment |

TABLE 4

| | | | | | | | |
|---|---|---|---|---|---|---|---|
| 00B1' | 21 | 0040! | 01060 | RBGSM: | LD | HL,AUTOFL | ;OP. ASST. EXIT SET ? |
| 00B4' | CB | 7E | 01070 | | BIT | 7,(HL) | |
| 00B6' | 20 | 04 | 01080 | | JR | NZ,RBGSM2 | ;YES |
| 00B8' | CB | 96 | 01090 | | RES | 2,(HL) | ;NO - RST P.T. FLAG |
| 00BA' | CB | 9E | 01100 | | RES | 3,(HL) | ;RST S.T. FLAG |
| 00BC' | 2A | 0050! | 01110 | RBGSM2: | LD | HL,(NXTCMD) | |
| 00BF' | 7A | | 01120 | | LD | A,D | ;GET FABRIC SENSOR CODE |
| 00C0' | E6 | 1C | 01130 | | AND | 1CH | |
| 00C2' | CB | 3F | 01140 | | SRL | A | |
| 00C4' | CB | 3F | 01150 | | SRL | A | |
| 00C6' | 32 | 0060! | 01160 | | LD | (FBSNCD),A | ;SAVE CODE |
| 00C9' | 7A | | 01170 | | LD | A,D | ;GET SNSR CHANGE STCH CNT |
| 00CA' | E6 | 03 | 01180 | | AND | 3 | |
| 00CC' | 57 | | 01190 | | LD | D,A | |
| 00CD' | 7E | | 01200 | | LD | A,(HL) | |
| 00CE' | CB | 27 | 01210 | | SLA | A | |
| | CB | 27 | 01220 | | SLA | A | |
| | CB | 27 | 01230 | | SLA | A | |
| | 5F | | 01240 | | LD | E,A | |
| | CB | 23 | 01250 | | SLA | E | |
| | CB | 12 | 01260 | | RL | D | |
| | CB | 23 | 01270 | | SLA | E | |
| | CB | 12 | 01280 | | RL | D | |
| | 23 | | 01290 | | INC | HL | |
| | 7E | | 01300 | | LD | A,(HL) | |
| | 23 | | 01310 | | INC | HL | |
| | 22 | 0050! | 01320 | | LD | (NXTCMD),HL | |
| | B3 | | 01330 | | OR | E | |
| | 5F | | 01340 | | LD | E,A | |

TABLE 4-continued

| | | | | | | |
|---|---|---|---|---|---|---|
| 21 | 0000 | 01350 | | LD | HL,0 | ;CLR SEAM STITCH CNT |
| 22 | 005A! | 01360 | | LD | (SMSTCT),HL | |
| B7 | | 01370 | | OR | A | ;IS FAB. SNSR. CNT = 0 ? |
| ED | 52 | 01380 | | SBC | HL,DE | |
| 28 | 24 | 01390 | | JR | Z,RBGSM3 | ;YES - NO WINDOW ENABLE |
| 2A | 0000* | 01400 | | LD | HL,(FSCNT) | ;NOT 0, IS IT L.T. MIN. ? |
| 37 | | 01410 | | SCF | | |
| ED | 52 | 01420 | | SBC | HL,DE | |
| 30 | 1C | 01430 | | JR | NC,RBGSM3 | ;LESS THAN MINIMUM |
| 21 | 0040! | 01440 | | LD | HL,AUTOFL | ;SET WINDOW ENABLE FLAG |
| CB | F6 | 01450 | | SET | 6,(HL) | |
| ED | 53 005C! | 01460 | | LD | (FBSNCT),DE | |
| D5 | | 01470 | | PUSH | DE | ;CALC. WINDOW CNT |
| E1 | | 01480 | | POP | HL | |
| 06 | 02 | 01490 | | LD | B,2 | |
| CB | 3A | 01500 | RBGSM1: | SRL | D | |
| CB | 1B | 01510 | | RR | E | |
| 10 | FA | 01520 | | DJNZ | RBGSM1 | |
| B7 | | 01530 | | OR | A | |
| ED | 52 | 01540 | | SBC | HL,DE | |
| 22 | 005E! | 01550 | | LD | (FBSNWC),HL | ;SAVE WINDOW CNT |
| C3 | 0000* | 01560 | | JP | RBKGRD | |
| 21 | 0040! | 01570 | RBGSM3: | LD | HL,AUTOFL | ;RST WINDOW FLAG |
| CB | B6 | 01580 | | RES | 6,(HL) | |
| C3 | 0000* | 01590 | | JP | RBKGRD | |

TABLE 5

| | | | | | | | |
|---|---|---|---|---|---|---|---|
| | | | 01360 | ; | | | |
| | | | 01370 | ; AUTO - SEWING TAUGHT PROFILE | | | |
| | | | 01380 | ; | | | |
| 0105' | 21 | 003C! | 01390 | RST028:: | LD | HL,NDLFLG | ;NEEDLE DOWN INTR. ? |
| 0108' | CB | 46 | 01400 | | BIT | 0,(HL) | |
| 010A' | 2B | 40 | 01410 | | JR | Z,RS028A | ;NO |
| 010C' | CD | 0000* | 01420 | | CALL | RGETST | ;YES - GET NEXT STITCH |
| | | | 01000 | ; | | | |
| | | | 01010 | ; ROUTINE TO DECODE ANOTHER STITCH CMD IN AUTO MODE | | | |
| | | | 01020 | ; | | | |
| 008B' | CB | 86 | 01030 | RGETST:: | RES | 0,(HL) | ;RESET NEEDLE DOWN INTR. |
| 008D' | 2A | 005A! | 01040 | | LD | HL,(SMSTCT) | ;INCR. SEAM STITCH CNT |
| 0090' | 23 | | 01050 | | INC | HL | |
| 0091' | 22 | 005A! | 01060 | | LD | (SMSTCT),HL | |
| 0094' | 2A | 00A1! | 01070 | | LD | HL,(SEGCNT) | ;DECR. SEGMENT CNT |
| 0097' | 11 | 0001 | 01080 | | LD | DE,1 | |
| 009A' | B7 | | 01090 | | OR | A | |
| 009B' | ED | 52 | 01100 | | SBC | HL,DE | |
| 009D' | 28 | 13 | 01110 | | JR | Z,RGET15 | ;SEG. CNT = 0 |
| 009F' | 38 | 11 | 01120 | | JR | C,RGET15 | ;SEG. CNT = −1 |
| 00A1' | 22 | 00A1! | 01130 | | LD | (SEGCNT),HL | ;SEG. CNT G.T.E. 2 |
| 00A4' | 3A | 00A3! | 01140 | | LD | A,(STCHCT) | ;GET CNT OF STCHS DECODED |
| 00A7' | 3D | | 01150 | | DEC | A | |
| 00A8' | 32 | 00A3! | 01160 | | LD | (STCHCT),A | |
| 00AB' | FE | 00 | 01170 | | CP | 0 | ;OUT OF DECODED STCHS ? |
| 00AD' | C2 | 016C' | 01180 | | JP | NZ,RGETS1 | ;NO |
| 00B0' | 18 | 07 | 01190 | | JR | RGETS2 | ;YES |
| 00B2' | 21 | 0000 | 01200 | RGET15: | LD | HL,0 | ;SET SEG. CNT = 0 |
| 00B5' | 22 | 00A1! | 01210 | | LD | (SEGCNT),HL | |
| 00B8' | C9 | | 01220 | | RET | | ;RETURN |
| 00B9' | 2A | 0050! | 01230 | RGETS2: | LD | HL,(NXTCMD) | ;DECODE NEXT CMD |
| 00BC' | 7E | | 01240 | | LD | A,(HL) | |
| 00BD' | 23 | | 01250 | | INC | HL | |
| 00BE' | 22 | 0050! | 01260 | | LD | (NXTCMD),HL | |
| 00C1' | 57 | | 01270 | | LD | D,A | ;SAVE CMD |
| 00C2' | E6 | E0 | 01280 | | AND | 0E0H | ;GET CMD CODE |
| 00C4' | FE | 60 | 01290 | | CP | 60H | |
| 00C6' | 20 | 11 | 01300 | | JR | NZ,RGETS3 | |
| 00C8' | 3E | 01 | 01310 | | LD | A,1 | ;SINGLE STITCH |
| 00CA' | 32 | 00A3! | 01320 | RGETS5: | LD | (STCHCT),A | |
| 00CD' | 32 | 0061! | 01330 | | LD | (LSSTCT),A | |
| 00D0' | 7A | | 01340 | | LD | A,D | |
| 00D1' | E6 | 1F | 01350 | | AND | 1FH | |
| 00D3' | 32 | 00A0! | 01360 | | LD | (AUTSPD),A | |
| 00D6' | C3 | 016C' | 01370 | | JP | RGETS1 | |
| 00D9' | FE | 80 | 01380 | RGETS3: | CP | 80H | |
| 00DB' | 20 | 0C | 01390 | | JR | NZ,RGETS4 | |
| 00DD' | 2A | 0050! | 01400 | | LD | HL,(NXTCMD) | ;MULTIPLE STITCH |
| 00E0' | 7E | | 01410 | | LD | A,(HL) | |
| 00E1' | 23 | | 01420 | | INC | HL | |
| 00E2' | 22 | 0050! | 01430 | | LD | (NXTCMD),HL | |
| 00E5' | E6 | 1F | 01440 | | AND | 1FH | |
| 00E7' | 18 | E1 | 01450 | | JR | RGETS5 | |

TABLE 5-continued

```
00E9'  FE  A0        01460  RGETS4:  CP    0A0H
00EB'  20  75        01470           JR    NZ,RGETS6        ;NOT A VALID CMD
00ED'  7A            01480           LD    A,D              ;MISC. CMDS
00EE'  E6  0F        01490           AND   0FH              ;GET CODE
00F0'  FE  00        01500           CP    0
00F2'  20  0A        01510           JR    NZ,RGETS7
00F4'  3A  0095!     01520           LD    A,(CMNDS)        ;REVERSE
00F7'  F6  02        01530           OR    02H
00F9'  CD  0000*     01540  RGETS9:  CALL  ROUTCD
00FC'  18  BB        01550           JR    RGETS2           ;DECODE ANOTHER CMD
00FE'  FE  01        01560  RGETS7:  CP    1
0100'  20  08        01570           JR    NZ,RGETS8
0102'  3A  0095!     01580           LD    A,(CMNDS)        ;FORWARD
0105'  E6  FD        01590           AND   0FDH
0107'  C3  00F9'     01600           JP    RGETS9
010A'  FE  05        01610  RGETS8:  CP    5
010C'  20  0F        01620           JR    NZ,RGET16
010E'  21  0041!     01630           LD    HL,AUTOFL+1      ;OPERATOR ASSIST
0111'  CB  C6        01640           SET   0,(HL)
0113'  3A  0065!     01650           LD    A,(LIGHTS)       ;TURN ON OP. ASST. LT.
0116'  F6  08        01660           OR    08H
0118'  CD  0000*     01670           CALL  ROUTLT
011B'  18  9C        01680           JR    RGETS2           ;DECODE ANOTHER CMD
011D'  FE  07        01690  RGET16:  CP    7
011F'  20  07        01700           JR    NZ,RGET17
0121'  21  0096!     01710           LD    HL,FCTS          ;EXT. FCT. 4 ON
0124'  CB  DE        01720           SET   3,(HL)
0126'  18  35        01730           JR    RGET22
0128'  FE  08        01740  RGET17:  CP    8
012A'  20  07        01750           JR    NZ,RGET18
012C'  21  0096!     01760           LD    HL,FCTS          ;EXT. FCT. 4 OFF
012F'  CB  9E        01770           RES   3,(HL)
0131'  18  2A        01780           JR    RGET22
0133'  FE  09        01790  RGET18:  CP    9
0135'  20  07        01800           JR    NZ,RGET19
0137'  21  0096!     01810           LD    HL,FCTS          ;EXT. FCT. 5 ON
013A'  CB  E6        01820           SET   4,(HL)
013C'  18  1F        01830           JR    RGET22
013E'  FE  0A        01840  RGET19:  CP    0AH
0140'  20  07        01850           JR    NZ,RGET20
0142'  21  0096!     01860           LD    HL,FCTS          ;EXT. FCT. 5 OFF
0145'  CB  A6        01870           RES   4,(HL)
0147'  18  14        01880           JR    RGET22
0149'  FE  0B        01890  RGET20:  CP    0BH
014B'  20  07        01900           JR    NZ,RGET21
014D'  21  0096!     01910           LD    HL,FCTS          ;EXT. FCT. 6 ON
0150'  CB  EE        01920           SET   5,(HL)
0152'  18  09        01930           JR    RGET22
0154'  FE  0C        01940  RGET21:  CP    0CH
0156'  20  0A        01950           JR    NZ,RGETS6        ;NOT A VALID CMD
0158'  21  0096!     01960           LD    HL,FCTS          ;EXT. FCT. 6 OFF
015B'  CB  AE        01970           RES   5,(HL)
015D'  3A  0095!     01980  RGET22:  LD    A,(CMNDS)
0160'  18  97        01990           JR    RGETS9
0162'  3E  10        02000  RGETS6:  LD    A,16             ;ERROR - INVALID CMD
0164'  32  00E4!     02010           LD    (ERRCD),A
0167'  0E  32        02020           LD    C,50             ;GO TO ERROR STATES
0169'  C3  0000*     02030           JP    RSTCHG
016C'  21  0040!     02040  RGETS1:  LD    HL,AUTOFL        ;FAB. SNSR ENABLE FL SET?
016F'  CB  76        02050           BIT   6,(HL)
0171'  20  04        02060           JR    NZ,RGET10        ;YES
0173'  2A  00A1!     02070  RGET11:  LD    HL,(SEGCNT)      ;NO - CONTINUE SEWING
0176'  C9            02080           RET
0177'  2A  005A!     02090  RGET10:  LD    HL,(SMSTCT)      ;INCR. CNT OF STS. IN SM.
017A'  ED  5B 005E!  02100           LD    DE,(FBSNWC)      ;STS. SEWN G.T.E. WNDW ?
017E'  B7            02110           OR    A
017F'  ED  52        02120           SBC   HL,DE
0181'  38  F0        02130           JR    C,RGET11         ;NO - CONTINUE SEWING
0183'  3E  28        02140           LD    A,050O           ;YES - READ FABRIC SNSRS
0185'  D3  02        02150           OUT   (2),A
0187'  DB  07        02160           IN    A,(7)
0189'  E6  70        02170           AND   70H
018B'  47            02180           LD    B,A              ;SAVE
018C'  DB  07        02190  RGET13:  IN    A,(7)            ;READ AGAIN TO BE SURE
018E'  E6  70        02200           AND   70H
0190'  B8            02210           CP    B
0191'  2B  03        02220           JR    Z,RGET14         ;OK
0193'  47            02230           LD    B,A              ;DON'T AGREE, READ AGAIN
0194'  18  F6        02240           JR    RGET13
0196'  06  04        02250  RGET14:  LD    B,4
0198'  CB  3F        02260  RGET12:  SRL   A
019A'  10  FC        02270           DJNZ  RGET12
```

TABLE 5-continued

```
019C'  21   0060!    02280          LD    HL,FBSNCD     ;COMPARE TO FINAL CODE
019F'  AE            02290          XOR   (HL)
01A0'  20   D1       02300          JR    NZ,RGET11     ;NOT = , CONT. SEWING
01A2'  21   0040!    02310          LD    HL,AUTOFL     ;RST SNSR ENABLE FLAG
01A5'  CB   B6       02320          RES   6,(HL)
01A7'  C3   01F3'    02330          JP    RFSINI        ;EQUAL, RESTART AT FBSNCT
                     02340          PAGE
```

TABLE 6

```
                     02940  ; ROUTINE TO RESET STITCH COUNTERS AND TAUGHT
                     02950  ; COMMAND POINTER TO STITCH AT WHICH FABRIC SENSOR
                     02960  ; CHANGE WAS DETECTED DURING TEACH MODE
                     02970  ;
01F3'  CD   0335'    02980  RESINI::  CALL  RDECNC        ;DECR. PNTR TO PRESENT CM
01F6'  2A   005C!    02990  RFSI:     LD    HL,(FBSNCT)   ;PNTRS SET TO RIGHT STCH?
01F9'  ED   5B 005A! 03000          LD    DE,(SMSTCT)
01FD'  B7            03010          OR    A
01FE'  ED   52       03020          SBC   HL,DE
0200'  28   06       03030          JR    Z,RFS2        ;YES - NO ADJ. NEEDED
0202'  D2   024F'    03040          JP    NC,RFS3       ;NEED TO SKIP SOME STCHS
0205'  C3   02C0'    03050          JP    RFS4          ;NEED TO REPEAT SOME STS
0208'  CD   0326'    03060  RFS2:     CALL  RINCNC        ;INCR. PNTR TO NEXT CMD
020B'  2A   00A1!    03070          LD    HL,(SEGCNT)   ;IS SEG. CNT G.T. K ?
020E'  16   00       03080          LD    D,0
0210'  3A   0000*    03090          LD    A,(K)
0213'  5F            03100          LD    E,A
0214'  37            03110          SCF
0215'  ED   52       03120          SBC   HL,DE
0217'  30   10       03130          JR    NC,RFS5       ;YES
0219'  3E   00       03140  RFS17:    LD    A,0           ;NO - SET PLAT. SPD
021B'  32   004F!    03150          LD    (SD),A
021E'  21   003E!    03160          LD    HL,CTLFL      ;SET STOP OVERRIDE BIT
0221'  CB   CE       03170          SET   1,(HL)
0223'  E1            03180          POP   HL            ;DUMMY RETURN
0224'  0E   1F       03190          LD    C,31          ;GO SEW PLATEAU SPD
0226'  C3   0000*    03200          JP    RSTCHG
0229'  3A   004E!    03210  RFS5:     LD    A,(SPSTA)     ;ALREADY IN DYN. BRAKE ?
022C'  FE   02       03220          CP    2
022E'  28   E9       03230          JR    Z,RFS17       ;YES
0230'  3A   0095!    03240          LD    A,(CMNDS)     ;INSURE NOT IN PLAT. MD
0233'  E6   07       03250          AND   07H
0235'  CD   0000*    03260          CALL  ROUTCD
0238'  3E   01       03270          LD    A,1
023A'  32   004E!    03280          LD    (SPSTA),A
023D'  3A   00A0!    03290          LD    A,(AUTSPD)    ;SET SPD = TAUGHT SPD
0240'  32   00EA!    03300          LD    (SPEED),A
0243'  CD   0000*    03310          CALL  RLSPIN        ;APPLY LRN SPD INCREASE
0246'  CD   0016'    03320          CALL  RSPDOR        ;APPLY SPD OVRD FACTOR
0249'  E1            03330          POP   HL            ;DUMMY RETURN
024A'  0E   1C       03340          LD    C,28          ;SEW TAUGHT PROFILE
024C'  C3   0000*    03350          JP    RSTCHG
024F'  2A   00A1!    03360  RFS3:     LD    HL,(SEGCNT)   ;SKIP A STITCH
0252'  2B            03370          DEC   HL
0253'  22   00A1!    03380          LD    (SEGCNT),HL
0256'  2A   005A!    03390          LD    HL,(SMSTCT)
0259'  23            03400          INC   HL
025A'  22   005A!    03410          LD    (SMSTCT),HL
025D'  3A   00A3!    03420          LD    A,(STCHCT)
0260'  3D            03430          DEC   A
0261'  32   00A3'    03440          LD    (STCHCT),A
0264'  20   90       03450          JR    NZ,RFS1       ;CHECK IF ENOUGH SKIPPED
0266'  CD   0326'    03460  RFS9:     CALL  RINCNC        ;GET NEXT TAUGHT CMD
0269'  7E            03470          LD    A,(HL)
026A'  57            03480          LD    D,A           ;SAVE IT
026B'  E6   E0       03490          AND   0E0H
026D'  FE   60       03500          CP    60H
026F'  28   1A       03510          JR    Z,RFS6        ;SINGLE STITCH
0271'  FE   80       03520          CP    80H
0273'  28   24       03530          JR    Z,RFS7        ;MULTIPLE STITCH
0275'  FE   20       03540          CP    20H
0277'  28   2E       03550          JR    Z,RFS8        ;BEGIN SEGMENT
0279'  FE   40       03560          CP    40H
027B'  28   E9       03570          JR    Z,RFS9        ;PAUSE - GET ANOTHER CMD
027D'  FE   A0       03580          CP    0A0H
027F'  28   E5       03590          JR    Z,RFS9        ;MISC. CMD - GET ANOTHER
0281'  3E   14       03600          LD    A,20          ;INVALID - SET ERR. CODE
0283'  32   00E4!    03610          LD    (ERRCD),A
0286'  0E   32       03620          LD    C,50          ;GO TO ERROR STATE
0288'  C3   0000*    03630          JP    RSTCHG
028B'  7A            03640  RFS6:     LD    A,D           ;GET TAUGHT SPD
```

TABLE 6-continued

```
028C'  E6  1F      03650          AND  1FH
028E'  32  00A0!   03660          LD   (AUTSPD),A
0291'  3E  01      03670          LD   A,1          ;CNT OF STCHS DECODED=1
0293'  32  00A3!   03680          LD   (STCHCT),A
0296'  C3  01F6'   03690          JP   RFS1
0299'  7A          03700  RFS7:   LD   A,D          ;GET TAUGHT SPD
029A'  E6  1F      03710          AND  1FH
029C'  32  00A0!   03720          LD   (AUTSPD),A
029F'  23          03730          INC  HL           ;GET SECOND BYTE
02A0'  7E          03740          LD   A,(HL)
02A1'  32  00A3!   03750          LD   (STCHCT),A   ;CNT OF STCHS DECODED
02A4'  C3  01F6'   03760          JP   RFS1
02A7'  7A          03770  RFS8:   LD   A,D          ;GET SEGMENT CNT
02A8'  E6  1F      03780          AND  1FH
02AA'  57          03790          LD   D,A
02AB'  1E  00      03800          LD   E,0
02AD'  06  03      03810          LD   B,3
02AF'  CB  3A      03820  RFS10:  SRL  D
02B1'  CB  1B      03830          RR   E
02B3'  10  FA      03840          DJNZ RFS10
02B5'  23          03850          INC  HL           ;SECOND BYTE
02B6'  7E          03860          LD   A,(HL)
02B7'  B3          03870          OR   E
02b8'  5F          03880          LD   E,A
02B9'  ED  53 00A1!03890          LD   (SEGCNT),DE  ;SAVE SEG. CNT
02BD'  C3  0266'   03900          JP   RFS9         ;GET ANOTHER CMD
02C0'  3A  0061!   03910  RFS4:   LD   A,(LSSTCT)   ;ST. CNT = ORIGINAL CNT?
02C3'  47          03920          LD   B,A
02C4'  3A  00A3!   03930          LD   A,(STCHCT)
02C7'  B8          03940          CP   B
02C8'  30  15      03950          JR   NC,RFS11     ;YES
02CA'  2A  00A1!   03960  RFS12:  LD   HL,(SEGCNT)  ;NO - BACK UP A STITCH
02CD'  23          03970          INC  HL
02CE'  22  00A1!   03980          LD   (SEGCNT),HL
02D1'  2A  005A!   03990          LD   HL,(SMSTCT)
02D4'  2B          04000          DEC  HL
02D5'  22  005A!   04010          LD   (SMSTCT),HL
02D8'  3C          04020          INC  A
02D9'  32  00A3!   04030          LD   (STCHCT),A
02DC'  C3  01F6'   04040          JP   RFS1         ;CHCK IF BACKED UP ENOUGH
02DF'  CD  0335'   04050  RFS11:  CALL RDECNC       ;GET PREVIOUS TAUGHT CMD
02E2'  7E          04060          LD   A,(HL)
02E3'  57          04070          LD   D,A          ;SAVE IT
02E4'  E6  E0      04080          AND  0E0H
02E6'  FE  60      04090          CP   60H
02E8'  28  1A      04100          JR   Z,RFS13      ;SINGLE STITCH
02EA'  FE  80      04110          CP   80H
02EC'  28  26      04120          JR   Z,RFS14      ;MULTIPLE STITCH
02EE'  FE  20      04130          CP   20H
02F0'  28  2C      04140          JR   Z,RFS15      ;BEGIN SEGMENT
02F2'  FE  40      04150          CP   40H
02F4'  28  E9      04160          JR   Z,RFS11      ;PAUSE - GET ANOTHER CMD
02F6'  FE  A0      04170          CP   0A0H
02F8'  28  E5      04180          JR   Z,RFS11      ;MISC. CMD - GET ANOTHER
02FA'  3E  15      04190          LD   A,21         ;INVALID - SET ERR. CODE
02FC'  32  00E4!   04200          LD   (ERRCD),A
02FF'  0E  32      04210          LD   C,50         ;GO TO ERROR STATE
0301'  C3  0000*   04220          JP   RSTCHG
0304'  7A          04230  RFS13:  LD   A,D          ;GET TAUGHT SPD
0305'  E6  1F      04240          AND  1FH
0307'  32  00A0!   04250          LD   (AUTSPD),A
030A'  3E  01      04260          LD   A,1          ;SET ORG. ST. CNT = 1
030C'  32  0061!   04270  RFS16:  LD   (LSSTCT),A
030F'  3E  00      04280          LD   A,0          ;SET CNT DECODED = 0
0311'  C3  02CA'   04290          JP   RFS12        ;BACK UP A STITCH
0314'  7A          04300  RFS14:  LD   A,D          ;GET TAUGHT SPD
0315'  E6  1F      04310          AND  1FH
0317'  32  00A0!   04320          LD   (AUTSPD),A
031A'  23          04330          INC  HL
031B'  7E          04340          LD   A,(HL)
031C'  18  EE      04350          JR   RFS16
031E'  21  0000    04360  RFS15:  LD   HL,0          ;CLEAR SEG. CNT
0321'  22  00A1!   04370          LD   (SEGCNT),HL
0324'  18  B9      04380          JR   RFS11
                   04390          PAGE
                   04400  ; ROUTINE TO INCREMENT TAUGHT CMD POINTER TO
                   04410  ; NEXT CMD
                   04420  ;
0326'  2A  0050!   04430  RINCNC: LD   HL,(NXTCMD)
0329'  23          04440  RINCN1: INC  HL
032A'  7E          04450          LD   A,(HL)
032B'  E6  E0      04460          AND  0E0H
```

way of example, it will be understood that other types of auxiliary devices could be controlled in the same manner.

In view of the foregoing, it will be apparent that the present invention comprises a sewing machine control system having significant advantages over the prior art. The system herein utilizes a combination of stitch counting and edge detection to achieve precise seam lengths and end points. Most of the operations of the sewing machine are controlled by the microprocessor as a function of stitch count, however, the only stitch counting that is utilized to determine seam length comprises a relatively small variable number of stitches at the end of each seam. Spurious signals which could cause premature initiation of the final stitch countdown are avoided by setting up a window around the stitch count corresponding to the last change in sensor condition before the end of the seam. Other advantages will be apparent to those skilled in the art.

Although particular embodiments of the invention have been illustrated in the accompanying Drawing and described in the foregoing Detailed Description, it shall be understood that the invention is not limited only to the embodiments disclosed, but embraces any alternatives, equivalents, modifications and/or rearrangements of elements as fall within the scope of the invention as defined by the following Claims.

We claim:

1. In a sewing machine for performing a sewing operation involving a series of seam segments and having a reciprocable needle for stitching material advanced in a feed direction and controls for operating the sewing machine, the improvement which comprises:

means for counting the number of stitches being sewn;

material detection means mounted in spaced relationship with said needle for detecting a material edge following a seam segment;

memory means for storing a plurality of stitch counts corresponding to different seam segments in the sewing operation to be performed;

processing means responsive to said material detection means, said stitch counting means and said memory means for generating first and second output signals, said first output signal stopping said sewing machine a preprogrammed number of stitches after detection of the edge of said material, said preprogrammed number of stitches corresponding to the stitch count stored in said memory means for the particular seam segment being sewn; and means responsive to said second output signal for performing control of the sewing machine.

2. The sewing machine of claim 1, wherein said material detection means comprises at least one on/off sensor mounted ahead of said needle in a direction opposite the material feed direction.

3. The sewing machine of claim 1, wherein said material detection means comprises a pair of on/off sensors mounted in mutually spaced relationship ahead of said needle in a direction opposite the material feed direction.

4. The sewing machine of claim 1, wherein said material detection means comprises a lamp/photosensor and reflector mounted in vertically spaced relationship ahead of said needle in a direction opposite the material feed direction.

5. The sewing machine of claim 1 wherein said material detection means comprises an infrared emitter and sensor mounted in vertically spaced relationship ahead of said needle in a direction opposite the material feed direction.

6. The sewing machine of claim 1, wherein said processing and memory means is responsive to a preprogrammed total stitch count beyond said stored stitch counts to generate a signal stopping said sewing machine by said total stitch count.

7. In a semiautomatic sewing system including a sewing machine with a reciprocable needle for stitching material advanced in a feed direction and controls for operating said sewing machine, with means for counting stitches being sewn, and with sensors for detecting manipulation of the sewing machine controls, the improvement which comprises:

means mounted in spaced relationship with said needle for detecting the material periphery following a seam; and a microprocessor controller with plural operational modes coupled to said sewing machine controls and responsive to said stitch counting means and said material detection means, said microprocessor controller in one mode being operable to record the operational sequence of said sewing machine controls as a function of stitch count and to compute the terminal number of stitches for each seam between detection of the material periphery and the end point of said seam;

said microprocessor controller in another mode being responsive to said material detection means to operate said sewing machine controls and halt said sewing machine said terminal number of stitches after detection of the material periphery following the seam.

8. The semiautomatic sewing system of claim 7, wherein said material detection means comprises at least one on/off sensor mounted ahead of said needle in a direction opposite the material feed direction.

9. The semiautomatic sewing system of claim 7, wherein said material detection means comprises a lamp/photosensor and reflector mounted in vertically spaced relationship ahead of said needle in a direction opposite the material feed direction.

10. The semiautomatic sewing system of claim 7, wherein said material detection means comprises an infrared emitter of variable output and an associated sensor mounted in vertically spaced relationship ahead of said needle in a direction opposite the material feed direction.

11. The semiautomatic sewing system of claim 7, wherein said material detection means comprises a pair of on/off sensors mounted in mutually spaced relationship ahead of said needle in a direction opposite the material feed direction.

12. The semiautomatic sewing system of claim 7, wherein said microprocessor controller in said other mode is responsive to said material detection means only during a preprogrammed range of stitch counts to avoid spurious signals.

13. The semiautomatic sewing system of claim 7, wherein said microprocessor controller in said one mode stores the total number of stitches required for each seam, and wherein said microprocessor controller in said other mode reverts to said total stitch count for determining seam length absent of detection of the ma- TABLE 6-continued

```
032D'  FE  00    04470            CP    0
032F'  28  F8    04480            JR    Z,RINCN1
0331'  22  0050! 04490            LD    (NXTCMD),HL
0334'  C9        04500            RET
               04510  ; ROUTINE TO DECREMENT TAUGHT CMD PNTR TO
               04520  ; PREVIOUS CMD
               04530  ;
0335'  2A  0050! 04540  RDECNC:   LD    HL,(NXTCMD)
0338'  2B        04550  RDECN1:   DEC   HL
0339'  7E        04560            LD    A,(HL)
033A'  E6  E0    04570            AND   0E0H
033C'  FE  00    04580            CP    0
033E'  28  F8    04590            JR    Z,RDECN1
0340'  22  0050! 04600            LD    (NXTCMD),HL
0343'  C9        04610            RET
               04620            PAGE
```

Figure 12:
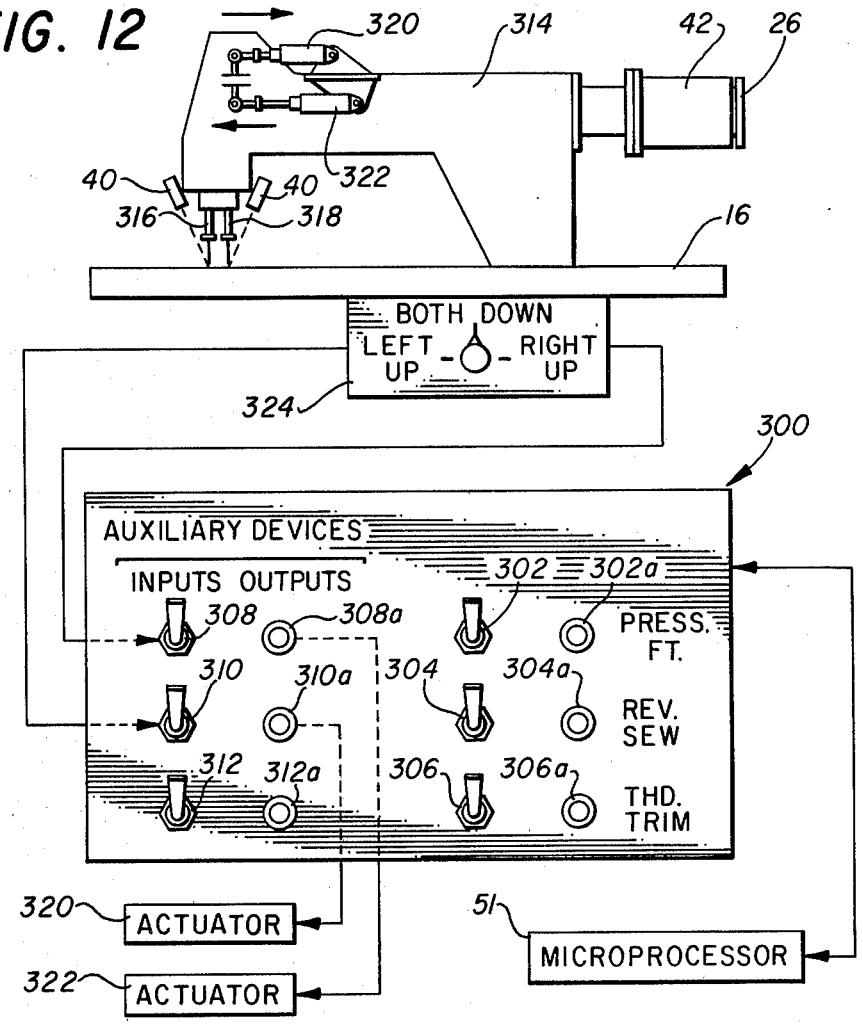
FIG. 12 is a side view of a programmable sewing system according to the invention with an interface module for controlling auxiliary devices.

With reference to FIG. 12, there is shown an optional interface module 300 which can be incorporated into semi-automatic sewing system 10 herein to control auxiliary devices as a function of stitch count. Interface module 300 is coupled between the microprocessor controller 51 and the auxiliary device to be controlled. As illustrated, the interface module 300 includes six input channels 302–312 and six corresponding output channels **302*a*–312*a*. Some of the inputs and corresponding outputs can be connected to devices usually found on a sewing machine, such as the presser foot lift actuator, reverse sew actuator and thread trimmer actuator. The other inputs and corresponding output channels of interface module 300** can be utilized to control auxiliary devices such as stackers, trimmers, guides, zig-zag actuators, and so forth.

Under the control of microprocessor controller 51, interface module 300 receives command switch closure type input signals and generates appropriate output actuation signals. Thus, in the teach or manual modes, a device can be operated manually through the appropriate command switch. When a device is manually actuated in the teach mode, however, interface module 300 senses control inputs to the device and transmits corresponding signals which are stored in the microprocessor controller 51 as a function of stitch count. In subsequent playback of the programmed operation in the auto mode, actuation of the devices through module 300 will be controlled automatically by microprocessor controller 51.

More particularly, FIG. 12 illustrates interface module 300 in conjunction with a split needle bar, double needle sewing machine 314, which is mounted on table top 16 similar to single needle sewing machine 12 shown in FIG. 1. For purposes of clarity, the various standard controls associated with sewing machine 314 have been omitted from FIG. 12, however, it will be appreciated that many of these controls are the same as those of sewing machine 12 shown in FIG. 1. A pair of sensors 40 and associated retroreflective strip (not shown) are mounted on machine 314. Sewing machine 314 includes a left needle 316 with associated presser foot and a right needle 318 with associated presser foot. Needles 316 and 318 can be operated in unison or individually by manual actuation of conventional throw-out mechanisms (not shown) connected to the needles. Suitable double-needle sewing machines, such as the Pfaff 542 or Juki LH-527, are commercially available.

A pair of actuators 320 and 322 are connected to the throw-out mechanisms of needles 316 and 318, respectively. A command switch 324 is connected between the needle throwout actuators 320 and 322 and auxiliary input channels 308 and 310 of module 300. The corresponding output channels **308*a* and 310*a* are wired to the actuators 320 and 322. In the manual and teach modes, needles 316 and 318 can be thrown out as desired by manual operation of switch 324, however, in the teach mode an appropriate control signal is generated and transmitted by module 300 for storage in the microprocessor controller 51 as a function of stitch count. In the auto mode of system 10, operation of actuators 320 and 322 is controlled automatically by microprocessor controller 51 without stopping sewing machine 314**.

Figure 13:
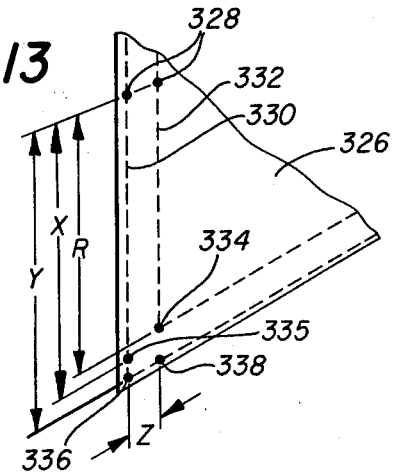
FIG. 13 is an illustration of a piece of material being provided with a double stitch pattern by means of the invention.

FIG. 13 illustrates the operation of a semiautomatic sewing system 10 with double needle sewing machine 314 sewing a double seam around a corner of a piece 326. In the teach mode, from starting points 328, both needles 316 and 318 are positioned down and operate to sew parallel seams 330 and 332 along one edge of piece 326. At point 334, the right needle 318 is raised or thrown-out after R stitches have been sewn. Sewing is continued with the left needle 316 of sewing machine 314 through point 335, where the condition of sensors 40 change at X stitches, as was discussed in reference to FIG. 5, until stopping at point 336 after Y stitches. The values R and X could be the same or different, depending upon the particular seam and shape of material being sewn. Piece 326 is then turned before Z initial stitches are sewn by the left needle 316, such as by manipulation of the one-stitch switch, before stopping at point 338 along seam 330. When left needle 316 reaches point 338, the right needle 318 is lowered again at point 334 and sewing of seam 332 is resumed as the left needle continues from point 338 sewing seam 330. The values R, X, Y and Z along with the last change in condition of sensors 40 for each seam sewn in the teach mode are stored in microprocessor controller 51.

In the auto mode of system 10, the throw-out mechanism for right needle 318 is activated at stitch count R as the left needle 316 continues stitching. As soon as the characteristic sensor 40 pattern is seen in the window (0.75X–1.05X) surrounding X, Y-X terminal stitches are sewn before stopping at end point 336 in accordance with a combination of stitch counting and edge detection as described hereinbefore. With the double needle sewing machines of the prior art, it was necessary to stop the sewing machine at each of the points 334, 336 and 338 for the operator to manually raise or lower one of the needles; however, in the auto mode of the present invention, only the right needle is stopped at point 334 as sewing machine 314 continues to point 336.

Although control of the throw-out mechanisms of a double needle sewing machine has been illustrated by terial periphery within a preprogrammed range of stitch counts.

14. The semiautomatic sewing system of claim 7, further including:

means for selectively controlling the acceleration and deceleration rates of said needle in said other mode.

15. The semiautomatic sewing system of claim 7, further including:

means for selectively controlling the maximum speed of said needle in said other mode.

16. The semiautomatic sewing system of claim 7, wherein said material is multiply material and said material detection means comprises a lamp/photosensor located above said material, and further including:

a reflector associated with said lamp/photosensor; and means for supporting said reflector on the opposite side of the material ply whose periphery is relevant to the seam being sewn.

17. A semiautomatic sewing system, comprising:

a sewing machine;

said sewing machine including a reciprocable needle for stitching a seam in material advanced along a feed direction, and controls for operating said sewing machine;

auxiliary means for performing a predetermined function associated with operation of said sewing machine;

means for counting stitches being sewn by said sewing machine;

means mounted in spaced relationship with said needle for detecting the material periphery following a seam;

a microprocessor controller responsive to said stitch counting means and said material detection means, and being coupled to said sewing machine controls and said auxiliary means;

said microprocessor controller having plural operational modes, and being operable in one mode to record the operational sequence of said sewing machine controls as a function of stitch count and to compute the terminal number of stitches for each seam between detection of the material periphery and the end point of said seam;

said microprocessor controller in said one mode being further operable to record the operational sequence of said auxiliary means as a function of stitch count;

said microprocessor controller in another mode being responsive to said material detection means to operate said sewing machine controls and halt said sewing machine said terminal number of stitches after detection of the material periphery following the seam; and said microprocessor controller in said other mode further being operable to control said auxiliary means.

18. The semiautomatic sewing system of claim 17, wherein said material detection means comprises at least one on/off sensor mounted ahead of said sewing machine needle in a direction opposite the material feed direction.

19. The semiautomatic sewing system of claim 17, wherein said material detection means comprises an infrared emitter with variable sensitivity and associated sensor mounted in vertically spaced relationship ahead of said sewing machine needle in a direction opposite the material feed direction.

20. The semiautomatic sewing system of claim 17, wherein said microprocessor controller in said other mode is responsive to said material detection means only during a preprogrammed window of stitch counts to avoid spurious signals.

21. The semiautomatic sewing system according to claim 20, wherein said microprocessor controller in said one mode stores the total number of stitches required for each seam, and wherein said microprocessor controller in said other mode reverts to said total stitch count for determining seam length absent detection of the material periphery within said preprogrammed window of stitch counts.

22. The semiautomatic sewing system of claim 17, wherein said sewing machine includes a second reciprocable needle and throw-out mechanisms for selectively controlling said needles, and wherein said auxiliary means comprises:

actuators coupled to the throw-out mechanisms of said sewing machine needles.

23. The semiautomatic sewing system of claim 17, further including:

means for commanding said sewing machine to sew a single stitch in said one mode and thereby incrementing the stitch count stored in said microprocessor controller.

24. A method of controlling seam lengths and end points sewn in material with a sewing machine, comprising the steps of:

providing a sensor for detecting the presence of material a predetermined distance ahead of the needle of said sewing machine;

storing a stitch count value X corresponding to a point near the end of each seam where a sensor status change should occur;

storing a stitch count value Y corresponding to the total number of stitches in each seam, at least a portion of said stitch count value Y being manually entered and stored by actuation of a one-stitch switch;

positioning the material for sewing under the needle of said sewing machine;

starting the sewing machine;

accelerating the sewing machine and operating the sewing machine at substantially constant speed over that portion of the seam where the stitch count value Y was manually incremented before stopping;

counting the number of stitches sewn in each seam beginning with the first stitch in the seam;

controlling auxiliary devices associated with the sewing machine as a function of stitch count;

comparing the stitch count with the stored stitch count values;

initiating countdown of $Y-X$ stitches responsive to a status change in said sensor; and stopping the sewing machine upon completion of the countdown of $Y-X$ stitches to complete each seam.

25. A method of controlling seam lengths and end points sewn in material with a sewing machine, comprising the steps of:

manually operating said sewing machine and each auxiliary device to sew seams on a similar piece of material;

sensing manual operation of auxiliary devices associated with the sewing machine to generate control input signals;

storing the control input signals of said auxiliary devices as a function of stitch count;

providing a sensor for detecting the presence of material a predetermined distance ahead of the needle of said sewing machine;

storing a stitch count value X corresponding to a point near the end of each seam where a sensor status change should occur;

storing a stitch count value Y corresponding to the total number of stitches in each seam;

positioning the material for sewing under the needle of said sewing machine;

starting the sewing machine;

counting the number of stitches sewn in each seam beginning with the first stitch in the seam;

controlling said auxiliary devices as a function of stitch count by generation of control output signals;

comparing the stitch count with the stored stitch count values;

initiating countdown of Y−X stitches responsive to a status change in said sensor;

stopping the sewing machine upon completion of the countdown of Y−X stitches to complete each seam; and generating subsequent control output signals for said auxiliary devices responsive to stitch count.

26. The method of claim 25, further including the steps of:

computing a window of stitch counts surrounding the stitch count value X;

comparing the stitch count with the stitch count value Y; and stopping said sewing machine absent a status change of said sensor within said window when said stitch count reaches said stitch count value Y.

27. The method according to claim 26, wherein said predetermined range of stitch counts is approximately 0.75X to 1.05X.

28. The method of claim 25, wherein the step of sensing the presence of material is carried out by at least one on/off sensor located ahead of the sewing needle.

29. The method of claim 25, wherein the steps of storing the stitch count values X and Y are carried out by:

manually operating said sewing machine to sew seams on an initial piece of material of similar shape;

counting the number of stitches sewn in each seam beginning with the first stitch in the seam;

setting X equal to the stitch count value upon a status change in said sensor; and setting Y equal to the stitch count value at the end of each seam.

30. The method according to claim 29, wherein said initial piece of material is relatively larger in size than subsequent pieces of material.

31. A method of performing a sewing operation involving a series of seams with a sewing machine having a reciprocable needle for stitching material advanced in a feed direction and controls for operating the sewing machine, the method comprising the steps of:

counting the number of stitches being sewn by the sewing machine;

detecting an edge of material following a seam;

storing a plurality of stitch counts corresponding to different seams in the sewing operation to be performed;

generating first and second output signals in response to the detection of said material edge, said counted number of stitches and said stored plurality of stitch counts;

stopping said sewing machine in response to said first output signal a preprogrammed number of stitches after detection of the material edge, said preprogrammed number of stitches corresponding to the stitch count stored for the particular seam being sewn; and performing control of the sewing machine in response to said second output signal.

32. The sewing machine of claim 1 and further comprising:

means for storing a maximum stitch count for each seam segment;

said processing means operable to stop said sewing machine at said maximum stitch count in the event said sensor does not detect the material edge within said maximum stitch count.

* * * * *